US007340191B2

(12) United States Patent
Yamada

(10) Patent No.: US 7,340,191 B2
(45) Date of Patent: Mar. 4, 2008

(54) IMAGE FORMING APPARATUS FEATURING VARIABLY-CONTROLLING A PRIMARY-TRANSFERRING CONDITION BASED ON A DETECTION RESULT OF COMBINED TONER IMAGES

(75) Inventor: Toshiyuki Yamada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/068,931

(22) Filed: Mar. 2, 2005

(65) Prior Publication Data

US 2005/0196190 A1 Sep. 8, 2005

(30) Foreign Application Priority Data

Mar. 4, 2004 (JP) ..... 2004-060449

(51) Int. Cl.
*G03G 15/20* (2006.01)

(52) U.S. Cl. ..... 399/66; 399/307

(58) Field of Classification Search ..... 399/66, 399/307, 40, 41, 49, 308
See application file for complete search history.

(56) References Cited

U.S. PATENT DOCUMENTS

| | | | | |
|---|---|---|---|---|
| 5,296,903 | A * | 3/1994 | Suzuki et al. | 399/66 |
| 5,809,365 | A * | 9/1998 | Yoshizawa | 399/31 |
| 5,963,756 | A * | 10/1999 | Sakai et al. | 399/39 |
| 6,985,678 | B2 * | 1/2006 | Maebashi et al. | 399/39 |
| 7,072,597 | B2 * | 7/2006 | Shimura et al. | 399/49 |
| 2004/0213594 | A1 * | 10/2004 | Takayanagi | 399/66 |

FOREIGN PATENT DOCUMENTS

| | | | |
|---|---|---|---|
| JP | 10010883 | A * | 1/1998 |
| JP | 10-133437 | | 5/1998 |
| JP | 2000-147849 | | 5/2000 |
| JP | 2000-147864 | | 5/2000 |
| JP | 2000147864 | A * | 5/2000 |
| JP | 2000-321832 | | 11/2000 |
| JP | 2002062713 | A * | 2/2002 |
| JP | 2002287440 | A * | 10/2002 |
| JP | 2003223022 | A * | 8/2003 |
| JP | 2005010564 | A * | 1/2005 |

* cited by examiner

*Primary Examiner*—Quana Grainger
(74) *Attorney, Agent, or Firm*—Fitzpatrick, Cella, Harper & Scinto

(57) ABSTRACT

An image forming apparatus includes an image bearing member, first toner image forming device of forming a first toner image by a first toner, second toner image forming device of forming a second toner image by a second toner, transferring device of transferring the first toner image on the image bearing member to a transferring medium, and electrostatically transferring the second toner image on the image bearing device so as to be overlaid on at least a portion of the first toner image transferred to the transferring medium, fixing device of mixing and fixing at least the first and second toner images on the transferring medium, and forming the mixed toner images on the transferring medium, detecting device of detecting the mixed toner images at least on the transferring device, and control device of variably controlling the transferring condition of the transferring device based on the detection result of the mixed toner images at least on the transferring medium of the detecting device. In this manner, a color taste of toner can be adjusted.

1 Claim, 13 Drawing Sheets

FIG. 2

| CIRCUMSTANTIAL MOISTURE AMOUNT (g/kg) | PRIMARY TRANSFER (μA) | | | |
|---|---|---|---|---|
| | K | Y | M | C |
| 0 | 55 | 85 | 100 | 85 |
| 3.03 | 55 | 85 | 100 | 85 |
| 3.42 | 55 | 85 | 100 | 85 |
| 3.81 | 56 | 86 | 101 | 86 |
| 4.21 | 56 | 87 | 102 | 87 |
| 4.6 | 57 | 88 | 103 | 88 |
| 4.99 | 57 | 88 | 103 | 88 |
| 5.38 | 58 | 89 | 104 | 89 |
| 5.77 | 59 | 90 | 105 | 90 |
| 6.17 | 59 | 91 | 106 | 91 |
| 6.65 | 60 | 92 | 107 | 92 |
| 7.13 | 60 | 93 | 108 | 93 |
| 7.61 | 61 | 93 | 108 | 93 |
| 8.09 | 62 | 94 | 109 | 94 |
| 8.57 | 62 | 95 | 110 | 95 |
| 9.05 | 63 | 96 | 111 | 96 |
| 9.53 | 63 | 96 | 111 | 96 |
| 10.01 | 64 | 97 | 112 | 97 |
| 10.5 | 64 | 98 | 113 | 98 |
| 11.44 | 65 | 98 | 113 | 98 |
| 12.38 | 65 | 99 | 114 | 99 |
| 13.32 | 66 | 100 | 115 | 100 |
| 14.26 | 66 | 100 | 115 | 100 |
| 15.2 | 67 | 101 | 116 | 101 |
| 16 | 67 | 102 | 117 | 102 |
| 16.8 | 68 | 102 | 117 | 102 |
| 17.6 | 68 | 103 | 118 | 103 |
| 18.4 | 69 | 104 | 119 | 104 |
| 19.2 | 69 | 104 | 119 | 104 |
| 20 | 70 | 105 | 120 | 105 |
| 20.8 | 70 | 105 | 120 | 105 |
| 21.6 | 70 | 105 | 120 | 105 |
| 21.6 | 70 | 105 | 120 | 105 |

IMAGE FORMING APPARATUS FEATURING VARIABLY-CONTROLLING A PRIMARY-TRANSFERRING CONDITION BASED ON A DETECTION RESULT OF COMBINED TONER IMAGES

BACKGROUND OF THE INVENTION

1. Field of the Invention

The present invention relates to an image forming apparatus adjusting a color taste of mixed toner images obtained by mixing a plurality of toner images by re-transferring at the time of transferring a toner image to a transferring medium in the image forming apparatus in which the toner image on an image bearing member is repeatedly transferred to the transferring medium.

2. Related Background Art

An image forming apparatus of an electrophotographic system has a change of a γ characteristic of image density (concentration) occurred due to the surrounding environment, the number of images formed, or the like. Particularly, a color image appears as a change of color taste and a gradation change of a highlight portion, and becomes a destabilizing factor of the image formation.

Hence, a method is adapted in which, by a desired image signal, an electrostatic latent image is formed on a photosensitive member, and the density (concentration) of a patch-shaped toner image (hereinafter referred to as "patch") having developed the electrostatic latent image is irradiated by a light from the light source such as an LED and the like, and its output value is density-converted and detected by a patch detection sensor receiving the reflected light by a photoelectric element or a control parameter such as an essential developing contrast and the like is corrected to a value decided in advance according to environment information such as temperature and humidity and variable factors such as the enduring number of sheets and the like.

For example, in the color image forming apparatus of the electrophotographic system comprising an intermediate transferring member, an adjustment to be made in case a magenta single color solid image is outputted in an adequate density will be simply described. In case a plurality of toner images are formed on the intermediate transferring member, a color sequence of the toner image formed on a photosensitive member is magenta (M), yellow (Y), cyan (C), and black (K), and the color sequence of primary-transferring by a primary-transferring apparatus on the intermediate transferring member from the photosensitive member is also taken as the same.

Here, in the primary-transferring process of the toner image on the intermediate transferring member from the photosensitive member, the toner image already formed on the intermediate transferring member is transferred again to the photosensitive member at the time of the primary-transferring of the subsequent colors, so that a portion of the toner image ends up being turned back to the photosensitive member.

FIG. 16 shows a toner amount on the intermediate transferring member after the primary transfer of the subsequent color in case the image formation of a single color solid image of a magenta toner M which is the first in the color sequence is performed (since the image consists of a magenta color only in a solid image with a single magenta color, a toner of subsequent color is not subjected to be primary-transferred, but subjected to the primary-transferring process). After the primary transfer of the magenta toner image M, on the intermediate transferring member, there exists an magenta toner amount of 0.60 mg/cm$^2$ adequate on the photosensitive member as the density of a solid image, but while passing through the primary-transferring process of an yellow toner image Y, an cyan toner image C, and a black toner image K, the magenta toner of 0.03 mg/cm$^2$ is re-transferred on the photosensitive member for each color, and the magenta toner amount on the intermediate transferring member after the completion of the primary-transferring process of the black toner image K becomes 0.51 mg/cm$^2$, and does not reach the magenta toner amount of 0.60 mg/cm$^2$ adequate on the photosensitive member as the density of the solid image, that is, an image of a thin density is outputted. Hence, in reality, after the transferring of the black toner image K which is the final color, based on the density signal measuring result of the magenta single color patch, an image density control parameter correction such as the developing contrast correction and the like is performed, and the magenta toner amount on the photosensitive member is adjusted, thereby outputting the magenta solid image of an adequate density.

However, while the image forming apparatus of the above-described constitution controls the density characteristic of each single color, in the actual image, these colors are mixed, and therefore, by each image forming process condition such as a transferring process condition, a fixing process condition and the like, an environmental fluctuation and the like, a color balance subtly changes, and this is perceived by an observer as a change of color taste.

For example, in case an attempt is made to overlay the toner of three colors of yellow, magenta, and cyan so as to produce black, each color is ill-balanced so that the color does not look like black, but a mixture of the other colors.

In this manner, a change of color taste is relatively seizable by a memory of an achromatic color, a flesh color and the like, and this is liable to be pointed out as a problem in the case of a full color copying machine.

For such a color taste change in a plurality of colors, a proposal has been made in Japanese Patent Application Laid-Open No. 2000-0147864 wherein, in the image forming apparatus comprising a transferring fixing apparatus (simultaneous transferring fixing apparatus), and patches overlaid with toners of at least more than two colors are formed on an intermediate transferring belt, and these toner images are fixed and mixed on the intermediate transferring belt by the transferring fixing apparatus, and the color information of the patches is detected by color information detecting means disposed by opposing to the toner image transferring fixing surface of the intermediate transferring belt in the downstream side of the transferring fixing apparatus in the moving direction of the intermediate transferring belt, and based on this detection result, the image density control parameter is controlled.

The image density control parameter to be controlled includes a laser power in an exposing apparatus, a charge potential of the photosensitive drum surface by a charging apparatus, a developing bias of a developing apparatus, and the like, and makes it possible to control a color taste change for a plurality of colors by controlling these apparatuses.

However, in case the image density control parameter is controlled for the image of the single color and the image of plural colors, respectively, the following problems arise in the primary-transferring process.

That is, in case the image density control parameter is controlled in order to output an image of a certain single color in an adequate density, an adequate color taste cannot be obtained in plural colors images including that color. Further, in case the image density control parameter is controlled in order to output plural color images in an adequate density, an adequate density cannot be obtained in the single color image included in those colors.

As an example, in the color image forming apparatus of the electrophotographic system comprising the intermediate transferring member, in case an attempt is made to output a magenta single color solid image (single color toner image) in an adequate density, a magenta toner amount of 0.60 mg/cm$^2$ is required on the intermediate transferring member after the primary transfer of a black toner image K, and hence, as is evident from FIG. 16, a magenta toner image (single color toner image) of approx. 0.69 mg/cm$^2$ is formed on the photosensitive member. However, in plural color images including the magenta toner (mixed color toner images), for example, a red R (M+Y) solid image, the magenta toner on the intermediate transferring member follows after the primary transfer of the black toner image K without being re-transferred since a yellow toner image is primary-transferred onto the magenta toner image on the intermediate transferring member at the primary transfer time of the yellow toner image Y in a color sequence. That is, the magenta toner amount on the intermediate transferring member becomes 0.69 mg/cm$^2$ at the red R solid image forming time, and the magenta toner amount of the outputted red solid image is plentiful, thereby causing a problem in that the image has a color taste tinged with more of magenta.

Here, to adjust the color taste of the solid image, in case the image density control parameter is controlled so that the magenta toner amount on the photosensitive member becomes 0.60 mg/cm$^2$, since the magenta toner amount on the intermediate transferring member is reduced to 0.51 mg/cm$^2$ due to the re-transferring, on the other hand, the magenta solid image having an adequate density cannot be obtained.

SUMMARY OF THE INVENTION

Hence, it is an object of the present invention to provide an image forming apparatus which prevents a re-transferring from occurring and adjusts the color taste of mixed color toner images obtained by mixing a plurality of toner images in case the toner image on an image bearing member is repeatedly transferred to an transferring medium.

Another object is to provide an image forming apparatus, comprising: an imager bearing member; first toner image forming means of forming a first toner image by using a first toner on said image bearing member; second toner image forming means of forming a second toner image by using a second toner on said image bearing member; transferring means of transferring said first toner image on said image bearing member on a transferring medium and electrostatically transferring said second toner image on said image bearing member to said transferring medium so as to be overlaid at least on a portion of said first toner image transferred on said transferring medium; fixing means of mixing and fixing at least said first and second toner images on said transferring medium and forming mixed toner images on said transferring medium; detecting means of detecting said mixed toner images at least on said transferring medium; and control means of variably controlling a transferring condition of said transferring means based on the detection result of at least said mixed toner images on said transferring medium of said detecting means.

BRIEF DESCRIPTION OF THE DRAWINGS

FIG. 2 is a control table of a primary transfer target current value of each color;

DESCRIPTION OF THE PREFERRED EMBODIMENTS

In the present invention, a plurality of toner images are mixed and fixed by a fixing device, and the mixed toner images are formed on an intermediate transferring member or a transferring material. The mixed toner images on the intermediate transferring member of the transferring material are detected by detecting means, and based on the detection result, a transferring condition is variably controlled when the toner image on the image bearing member is transferred to the transferring medium.

That is, since the detection of the mixed toner images makes it possible to grasp the occurrence situation of a re-transferring, the transferring condition can be controlled so that the re-transferring is prevented from occurring, thereby preventing the occurrence of the re-transferring and adjusting the color taste of the mixed toner images.

Embodiments of the present invention will be described below in detail.

First Embodiment (1) Schematic Structure of Image Forming Apparatus Example

Figure 1:
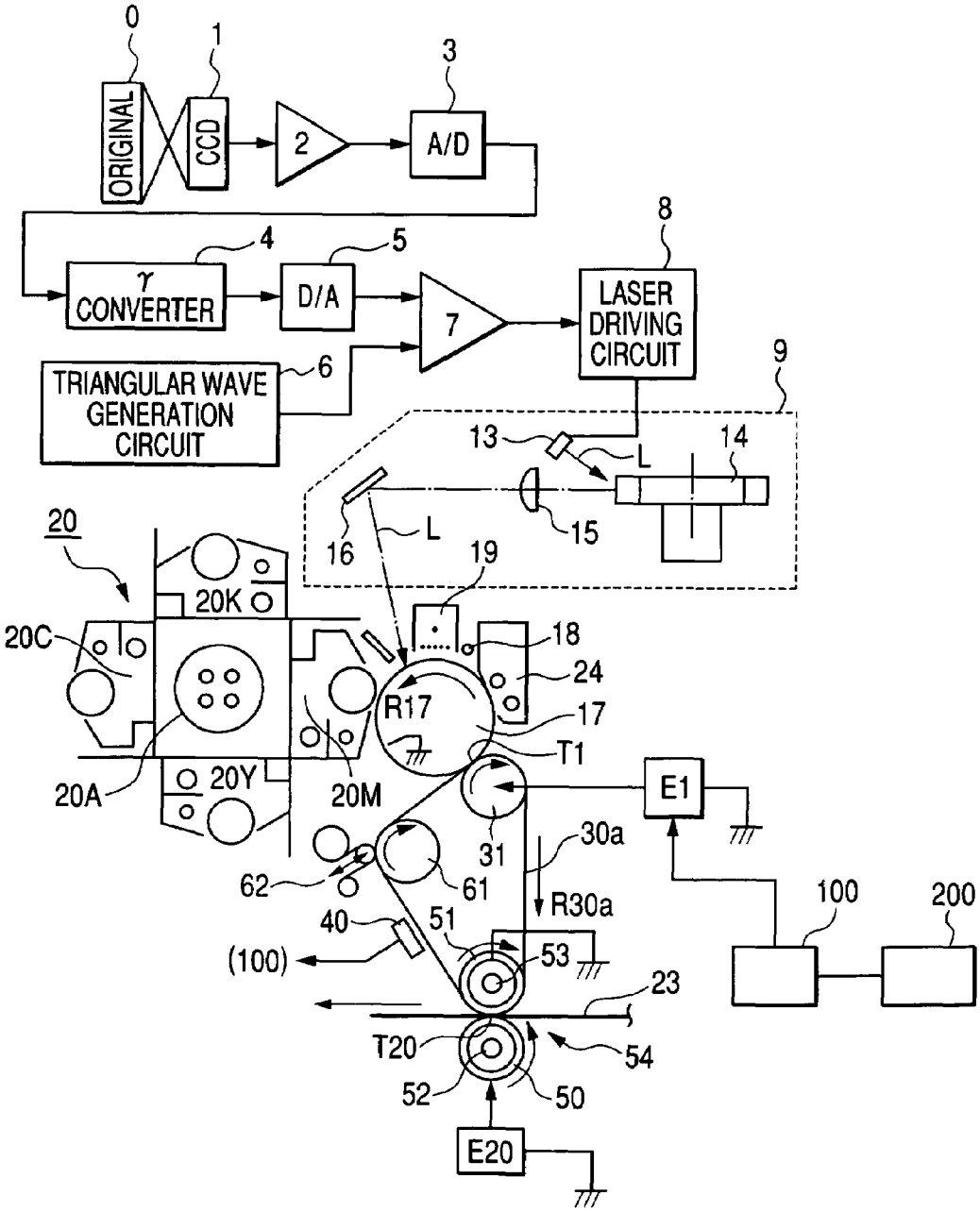
FIG. 1 is a schematic block diagram of an image forming apparatus of a first embodiment.

FIG. 1 is a vertical section showing a schematic structure of an image forming apparatus in a first embodiment. The image forming apparatus of the present embodiment is a four-color full color electrophotographic image forming apparatus of a system in which a toner image formed on an electrophotographic photosensitive member as a first image bearing member by charging, exposing and developing is primary-transferred on an intermediate transferring member as a second image bearing member, and this is repeated for each color, thereby synthetically forming color toner images composed by overlaying each color toner image on the intermediate transferring member, and these synthetically formed color toner images are collectively secondary-transferred on the transferring material from above the intermediate transferring member by a transferring fixing apparatus (simultaneous transferring and fixing apparatus, fixing means), and at the same time, are fixed and mixed.

That is, this image forming apparatus comprises a drum type electrophotographic photosensitive member (hereinafter referred to as photosensitive drum) 17 as a first image bearing member. The photosensitive drum 17 is rotationally driven counter-clockwise in the direction of an arrow mark R17 by driving means (not shown) at a predetermined peripheral velocity. Around the photosensitive drum 17, there is disposed image forming means. As this image forming means, though arbitrary means can be adapted, the present embodiment comprises a primary charging device 19 for uniformly charging the surface of the photosensitive drum 17, an apparatus 9, for example, such as a laser exposing apparatus for irradiating a light figure which subjects a color image to a color separation or the light figure equivalent to this on the photosensitive drum 17 and forms an electrostatic latent image of the image, a rotary type developing apparatus 20 for developing the electrostatic latent image on the photosensitive drum 17 and visualizing it as a toner image, and the like.

The exposing apparatus 9 in the present embodiment is a laser beam exposing apparatus, which comprises a laser diode 13, a polygon mirror 14, a fθ lens 15, a reflecting mirror 16, and the like. The image of an original document 0 is read by a CCD 1, and the obtained analogue image signal is amplified by an amplifier 2 to a predetermined level, and is converted, for example, into an eight bit (0 to 255 gradation) digital image signal by an analogue/digital converter (A/D converter) 3. Next, this digital image signal is supplied to a γ converter (which is constituted by a data of 256 bytes in the present embodiment, and performs a density conversion by a look up table system) 4, and after being γ-corrected, it is inputted to a digital/analogue converter (D/A converter) 5. Here, the digital image signal is converted into an analogue signal again, and becomes one input of a comparator 7. The other input, a triangular wave signal, is supplied to the comparator 7 from a triangular wave signal generation circuit 6 of a predetermined cycle generated from a triangular wave generation circuit 6, and an analogue image signal supplied to one input of the comparator 7 is compared with this triangular wave signal, and is pulse-width-modulated. This pulse-width-modulated binary value image signal is inputted to a laser driving circuit 8, and is used as an ON/OFF control signal of emission of the laser diode 13 of an exposing apparatus 9. A laser L radiated from the laser diode 13 is scanned in a main scanning direction by the known polygon mirror 14, and is radiated on the photosensitive drum 17 rotated through the fθ lens 15 and the reflecting mirror 16. The photosensitive drum 17 is uniformly eliminated from a residual charge by an exposing device 18, and after that, is uniformly charged, for example, negatively charged by a primary charging device 19. After that, the photosensitive drum 17 receives irradiation of the laser L, thereby forming an electrostatic latent image corresponding to the image signal.

The developing apparatus (toner image forming means) 20 is constituted by a rotary 20A rotatably supported, and four sets of developing devices mounted on this rotary, that is, a developing device 20M (first toner image forming means), 20Y (second toner image forming means), 20C, and 20K storing a magenta toner (magenta developer, a first toner), a yellow toner (yellow developer, a second toner), a cyan toner (cyan developer), and a black toner (black developer), respectively. The developing apparatus 20 develops the electrostatic latent image on the photosensitive drum 17 as a toner image (visible image) in such a manner that the developing device storing the toner of the color corresponding to the electrostatic latent image formed on the photosensitive drum 17 is carried to a developing position opposed to the outer peripheral surface of the photosensitive drum 17 by the rotation of the rotary 20A. The developing device 20 is superposed and applied with a DC bias component corresponding to an electrostatic image forming condition and an AC bias component for improving a developing efficiency.

Reference numeral 30*a* denotes an intermediate transferring member (transferring medium). The intermediate transferring member in the present embodiment is a flexible endless belt member (hereinafter described as intermediate transferring belt), and is wound and spanned among three pieces of spanning rollers of a primary-transferring charging roller 31 as a primary-transferring charging device (transferring means), a fixing portion opposed roller 51 of the transferring fixing apparatus (fixing means) 54, and a tension roller 61. The primary-transferring charging roller (transferring means) 31 is compressed to the photosensitive drum 17 through the intermediate transferring belt 30, thereby forming a primary-transferring portion (nip portion) T1 between the photosensitive drum 17 and the intermediate transferring belt 30. Further, the fixing portion opposed roller 51 is compressed to the fixing roller 50 with the intermediate transferring belt 30 nipped between thereof, thereby forming a secondary transferring portion (nip portion) T2 between the intermediate transferring belt 30 and the fixing roller 50. This fixing roller 50 and the fixing portion opposed roller 51 constitute the transferring fixing apparatus 54.

For the intermediate transferring belt 30, for example, a belt of two layer structure having a base layer and an upper surface layer. As the base layer, polyimide (PI), polyetherketon (PEEK), ployamide imide (PAI), polyethersulfon (PES), polyethernitril (PEN), and the like are used, but polyimide is often used in many cases in consideration of heat resistance and mechanical strength. In the present embodiment, as the base layer, a polyimide film in which carbon black is distributed and subjected to a semiconduction electrification treatment is used. Further, as the surface layer, a semiconductive silicon rubber having 50 degree in rubber hardness and 50 μm in thickness is used in consideration of adhesiveness with the transferring material of the intermediate transferring member, a mold release characteristic of the toner on the intermediate transferring belt, and heat resistance of the intermediate transferring belt at the time of secondary transferring and fixing of the toner image transferred on the intermediate transferring belt 30 on a recording material P. Further, a volume resistivity of the base layer is adjusted in resistance to $10^8$ to $10^{11}$ Ω·cm and a volume resistivity of the surface layer is adjusted in resistance to $10^{13}$ to $10^{15}$ Ω·cm in consideration of transferability of the toner formed in the photosensitive drum 17 to the intermediate transferring belt 30.

The primary-transferring charging roller 31 is a conductive elastic roller, and serves also as the driving roller of the intermediate transferring belt 30*a*. The intermediate transferring belt 30*a*, with the primary-transferring charging roller 31 rotated by driving means (not shown), is rotated clockwise in the direction of an arrow mark R 30*a* approximately at the same peripheral velocity as the photosensitive drum 17. Reference numeral E1 denotes a high voltage output circuit (bias apply power source, power source) for the primary-transferring charging roller 31.

The inner spaces of the fixing roller 50 and the fixing portion opposed roller 51 of the transferring fixing apparatus 54 are disposed with halogen heaters 52 and 53 as heating means, respectively. Further, the surfaces of the fixing roller 50 and the fixing portion opposed roller 51 are disposed with temperature control thermistors (not shown), respectively, and the halogen heaters 52 and 53 are ON/OFF controlled by the temperature information from the thermistors, and the temperatures of the fixing roller 50 and fixing opposed roller 51 are controlled to a predetermined level. In the present embodiment, the temperature is controlled to become 150° C. Particularly, the surface of the fixing roller 50 is coated with PFA which is a mold releasing fluorine contained resin, thereby preventing the adherence of the toner to the fixing roller side. Reference numeral E2 denotes a high voltage circuit (bias apply power source) for the fixing roller 50.

The tension roller 61 applies a certain degree of tensile force to the intermediate transferring belt 30. Reference numeral 62 is a cleaner, which is abutted and disposed against the surface (external surface) of the intermediate transferring belt 30 in the intermediate transferring belt winding portion of the tension roller 61. In the present embodiment, this cleaner 62 is a web-type cleaner.

Reference numeral 40 denotes a density detection sensor as detecting means, which is disposed by opposing non-contact to the intermediate transferring belt 30*a* surface (toner image transferred surface), in the downstream side of the moving direction of the intermediate transferring belt 30*a* from the fixing portion opposed roller 51 of the transferring fixing apparatus 54 and in the intermediate transferring belt portion of the upstream side of the moving direction of the intermediate transferring belt from the tension roller 61.

(2) Full Color Image Forming Operation

The image forming apparatus of the present embodiment forms in order four toner images of a magenta toner image, a yellow toner image, a cyan toner image, and a black toner image as component color images of a full color image on the surface of the photosensitive drum 17, and these toner images are superposingly transferred in order on the intermediate transferring belt 30 in a predetermined overlaid state in the first transferring portion T1, and those four color superposed toner images are collectively transferred on the transferring material 23 in the secondary transferring portion T20, and at the same time, are heated and fixed (fixing mixture), thereby obtaining a full color image formative matter. The image formation will now be described in more detail.

1) On the surface of the photosensitive drum 17 rotationally driven, first, there is formed the toner image of a magenta component of the full color image, and that magenta image is primary-transferred on the surface of the intermediate transferring belt 30 during its first rotation in the primary-transferring portion T1.

The primary transfer of the toner image from above the photosensitive drum 17 to above the intermediate transferring belt 30*a* is performed by applying a bias in reverse to the charging polarity of the toner to the primary-transferring charging roller 31 from the high voltage output circuit E1.

Further, the toner remaining (residual toner) on the surface of the photosensitive drum 17, which is not transferred on the intermediate transferring belt 30 in the primary-transferring portion T1, is scraped and removed from the surface of the photosensitive drum 17 by a cleaner 24, and the photosensitive drum 17 is repeatedly provided for image formation.

The toner image primary-transferred on the intermediate transferring belt 30*a* passes through the secondary transferring portion T20 again by the continuous rotation of the intermediate transferring belt 30*a*, and passes through the position of the cleaner 62 also and reaches the primary-transferring portion T1 again. In this case, the fixing roller 50 of the transferring fixing apparatus 54 controls, as described above, the adherence of the toner from the intermediate transferring belt 30*a* side to the fixing roller 50 side by a coating having an excellent mold release characteristic, and at the same time, with a bias of the same polarity as the charging polarity of the toner applied from the high voltage output circuit E2, the transferring of the toner image from above the intermediate transferring belt 30*a* to the fixing roller 50 is controlled. Further, the cleaner 62 is kept in a non-operating state in which a web is set free from the surface of the intermediate transferring belt 30*a* so as not to disturb the toner image on the intermediate transferring belt 30.

2) Next, on the surface of the photosensitive drum 17, a toner image of the yellow component of the full color image is formed, and that yellow toner image is primary-transferred on the magenta toner image already primary-transferred on the surface of the intermediate transferring belt 30*a* during its second rotation in a predetermined overlaid state in the first primary-transferring portion T1.

3) Next, on the surface of the photosensitive drum 17, a toner image of the cyan component of the full color image is formed, and that cyan toner image is primary-transferred on the magenta toner image and the yellow toner image already primary-transferred on the surface of the intermediate transferring belt 30*a* during its third rotation in a predetermined overlaid state in the primary-transferring portion T1.

4) Finally, on the surface of the photosensitive drum 17, the toner image of the black component of the full color image is formed, and that black toner image is primary-transferred on the magenta toner image, the yellow toner image, and the cyan toner image already primary-transferred on the surface of the intermediate transferring belt 30*a* during its fourth rotation in a predetermined overlaid state in the primary-transferring portion T1.

FIG. 2 shows a setting value of a target transferring current applied from the high voltage circuit E1 to the primary-transferring charging roller 31 at the primary-transferring time of the toner image of each color from above the surface of the photosensitive drum 17 to above the intermediate transferring belt 30*a*. The target primary-transferring current is variably controlled by a control circuit CPU (control means) 100 based on a circumstantial moisture amount obtained from the measurement result of a temperature sensor 200 which measures temperature and humidity inside the image forming apparatus. At an actual primary-transferring time, the control circuit performs a constant voltage control in such a manner that the primary-transferring current flows along the target current (controls a voltage so as to meet a target current and outputs at a constant voltage)(see Japanese Patent Application Laid-Open No. H08-022205).

5) In a predetermined timing with the conveyance of the four color superposed toner images to the secondary transferring portion T20 by the continuous rotation of the intermediate transferring belt 30*a* and the arrival of the top end portions of those toner images at the secondary transferring portion T2, the transferring material 23 is fed from a sheet feeding apparatus (not shown) so that the top end portions similarly reach the secondary transferring portion T20. Further, an applied bias to the fixing roller 50 from the high voltage output circuit E2 is switched from the same polarity bias as the toner charging polarity to a reverse polarity bias. In this manner, the four color superposed toner images on the intermediate transferring belt 30*a* are collectively transferred in order on the transferring material 23 in the secondary transferring portion T20, and at the same time, are heated and fixed (fixing mixture), and a full color image formative matter is discharged outside of the image forming apparatus.

Further, the cleaner 62 is switched and kept in an operating state in which the web is pressed and contacted on the surface of the intermediate transferring belt 30*a*. In this manner, the toner (residual toner) remained on the surface of the intermediate transferring belt 30*a*, which is not transferred on the transferring material 23 in the secondary transferring portion T20, is brushed off by the web of the cleaner 62, and is removed, and the intermediate transferring belt 30*a* is repeatedly provided for image formation.

(3) Color Taste Adjustment Mode

Now, the image forming apparatus of the present embodiment is controlled to retain an image (toner image) density on the photosensitive drum 17 constant by controlling the density to a developing contrast potential decided in advance according to respective environmental states based on temperature and humidity information from the environmental sensor 200.

However, though the image density of each color is controlled, a balance of color is subtly tipped off, and comes to a level where the difference of colors can be recognized.

In the present embodiment, in a preliminary rotational operating process of the image forming apparatus, the patches (patch-shaped toner images) of a single color and a plurality of colors are overlaid on the intermediate transferring belt 30*a*, and these patches are fixed and mixed on the intermediate transferring belt 30*a* without allowing the transferring material to pass through the secondary transferring portion T20, and the density of these toner images is detected by the density detection sensor 40 as the detecting means, and based on this detection result, a color taste adjustment mode to control the primary-transferring condition in the color image forming process to be executed next time is provided by the control circuit CPU 100. In this manner, the problem is solved.

Here, the preliminary rotational process is a period in which the image forming apparatus is allowed to perform a preliminary image forming operation for a while by activating a main motor of the image forming apparatus by input of a print start signal to the image forming apparatus in a standby state.

This color taste adjustment mode can make the most accurate and best adjustment by executing it in a preliminary rotational operation. In case a delay of the print operation is disfavored, the print operation can be incorporated into a sequence to be executed in a subsequent rotational process after the completion of one job. Further, in the case of the job of the large quantity of sheets in succession, for example, the job can be incorporated into a sequence in which the color taste adjustment mode is executed once for several hundred sheets. Further, the user can execute the color taste adjustment mode at his discretion.

Figure 7:
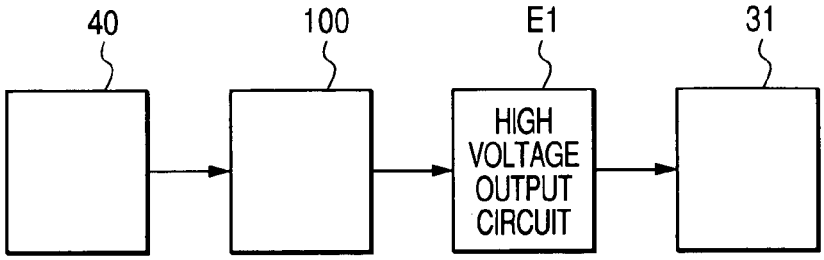
FIG. 7 is a block diagram of a control circuit system for executing a color taste adjustment mode.

A description will be made below in more detail. As shown in FIG. 1, the density sensor 40 as the detecting means is disposed so as to be in the downstream side of the transferring fixing apparatus 54 in the rotational direction (in the direction of the arrow mark 30*a*) of the intermediate transferring belt 30*a*, and moreover, in opposition to the toner image transferring surface (outer peripheral surface) of the intermediate transferring belt 30*a*, and detects color information of the single color patches P1 and P2, and plural color patches P3 and P4 fixed and mixed on the intermediate transferring belt 30*a* by the transferring fixing apparatus 54. The detection information is inputted to the control circuit CPU 100 (FIGS. 1 and 7).

Figure 3:
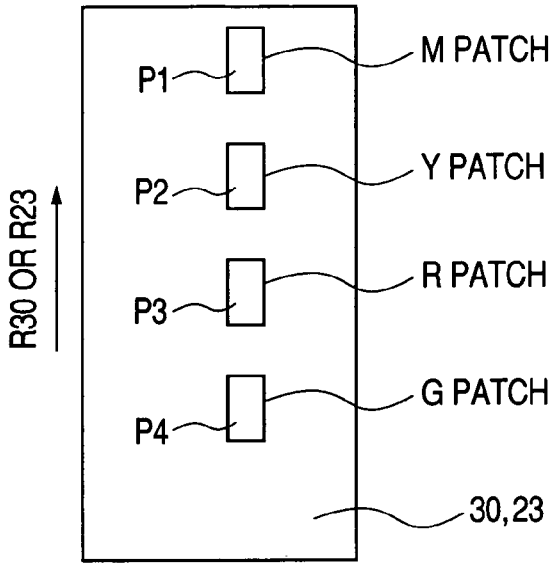
FIG. 3 is a view of a patch formed on an intermediate transfer belt.

FIG. 3 shows the patches P1 (M patch, magenta M single color) and P2 (Y patch, yellow Y single color), P3 (R patch, plural colors red: R(M+Y)), and P4 (G patch, plural colors green: G(M+C)) formed on the intermediate transferring belt 30.

The detail of a forming method of the patches P1, P2, P3 and P4 will be described below.

First, the electrostatic image formed on the photosensitive drum 17 (image bearing body) is developed by a magenta developing device 20M (first toner image forming means) by using a magenta toner (first toner), so that a magenta toner image (first toner image) is formed at a position where the patches P1 and P3 are formed. Subsequently, the electrostatic image formed on the photosensitive drum 17 is developed by a yellow developing device 20Y (second toner image forming means) by using a yellow toner (second toner), so that a yellow toner image (second toner image) is formed at a position where the patches P2, P3, and P4 are formed. That is, the yellow toner image as the second toner image is transferred on the intermediate transferring belt (transferring medium) 30*a* by a primary-transferring charging device 31 (transferring means) so as to be overlaid on a portion (here P3) of the magenta toner image as the first toner image. Further, the magenta toner image is transferred to the intermediate transferring belt (transferring medium) 30*a* by the primary-transferring charging device 31 so as not to be overlaid on a portion (here P1) of the yellow toner image.

The yellow toner image and the magenta toner image transferred on the intermediate transferring belt 30*a* are fixed and mixed on the intermediate transferring belt 30*a* by the transferring fixing apparatus (fixing means) 54 without allowing the transferring material 23 to be fed to the secondary transferring portion T20, so that the red patch P3 (mixed toner images) is formed on the intermediate transferring belt 30*a*.

Further, in the magenta toner image, a portion which is not overlaid with other color toner images but transferred is fixed on the intermediate transferring belt 30*a* by the transferring fixing apparatus (fixing means) 54 without being mixed with the toner images of other colors, so that the magenta patch P1 (single color toner image) is formed on the intermediate transferring belt 30.

In the yellow toner image, a portion which is not overlaid with the toner images of other colors is fixed on the intermediate transferring belt 30*a* by the transferring fixing apparatus 54 without being mixed with the toner images of other colors, so that the yellow patch P2 (single color toner image) is formed on the intermediate transferring belt 30.

Similarly, after the cyan toner image is transferred so as to be overlaid on the yellow toner image on the intermediate transferring belt 30*a*, the yellow toner image and the cyan toner image on the intermediate transferring belt 30*a* are fixed and mixed on the intermediate transferring belt 30 by the transferring fixing apparatus 54, so that the P4 is formed.

The formation of these patches P1, P2, P3 and P4 is performed in the preliminary rotational process prior to the full color image forming process of the image forming apparatus. This formation can be, as described above, incorporated into a sequence to be executed in the subsequent rotational process after the completion of one job. Further, in the case of the job of the large quantity of sheets in succession, the job can be incorporated, for example, into a sequence in which the color taste adjustment mode is executed once for several hundred sheets. Further, the user can execute the color taste adjustment mode at his discretion.

The formation of such patches is executed in such a manner that a process of the primary-transferring of the toner image formed on the photosensitive drum 17 to the intermediate transferring belt 30*a* is repeated at least for two color toners, and the single color toner image and the toner image overlaid with at least two color toner images are formed and borne on the intermediate transferring belt, and those toner images are fixed on the intermediate transferring belt 30 itself by the transferring fixing apparatus 54 without allowing the transferring material 23 to be fed.

Figure 4A:
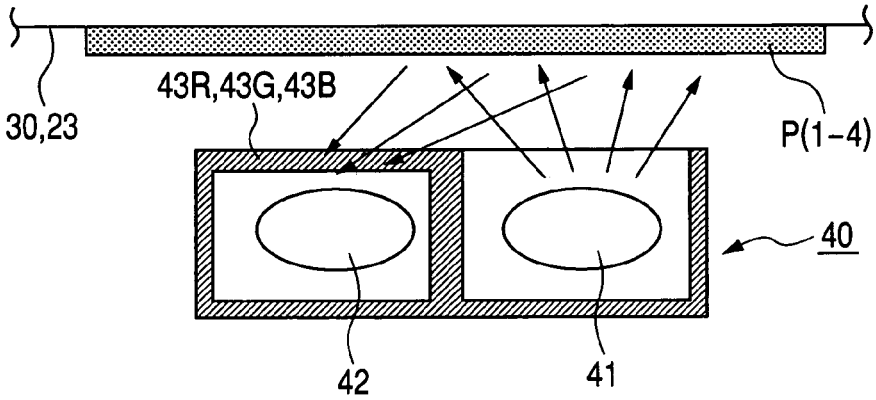
FIG. 4A is a vertical section showing a schematic structure of a density detection sensor.
Figure 4B:
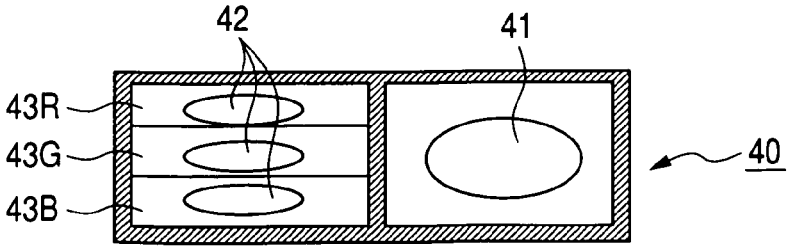
FIG. 4B is a top view showing a schematic structure of density detection sensor.

FIG. 4A is a vertical section showing a constitution of the density sensor 40 as detecting means. FIG. 4B is a top view thereof. The density detection sensor 40 comprises a light source 41 for irradiating the patches P (1 to 4) formed on the intermediate transferring belt 30, and a light receiving element 42 for receiving a reflecting light. As shown in FIG. 4B, between the light receiving element 42 and the patches P (1 to 4), there are disposed color separation filters 43R, 43G, and 43B of each color.

Figure 5:
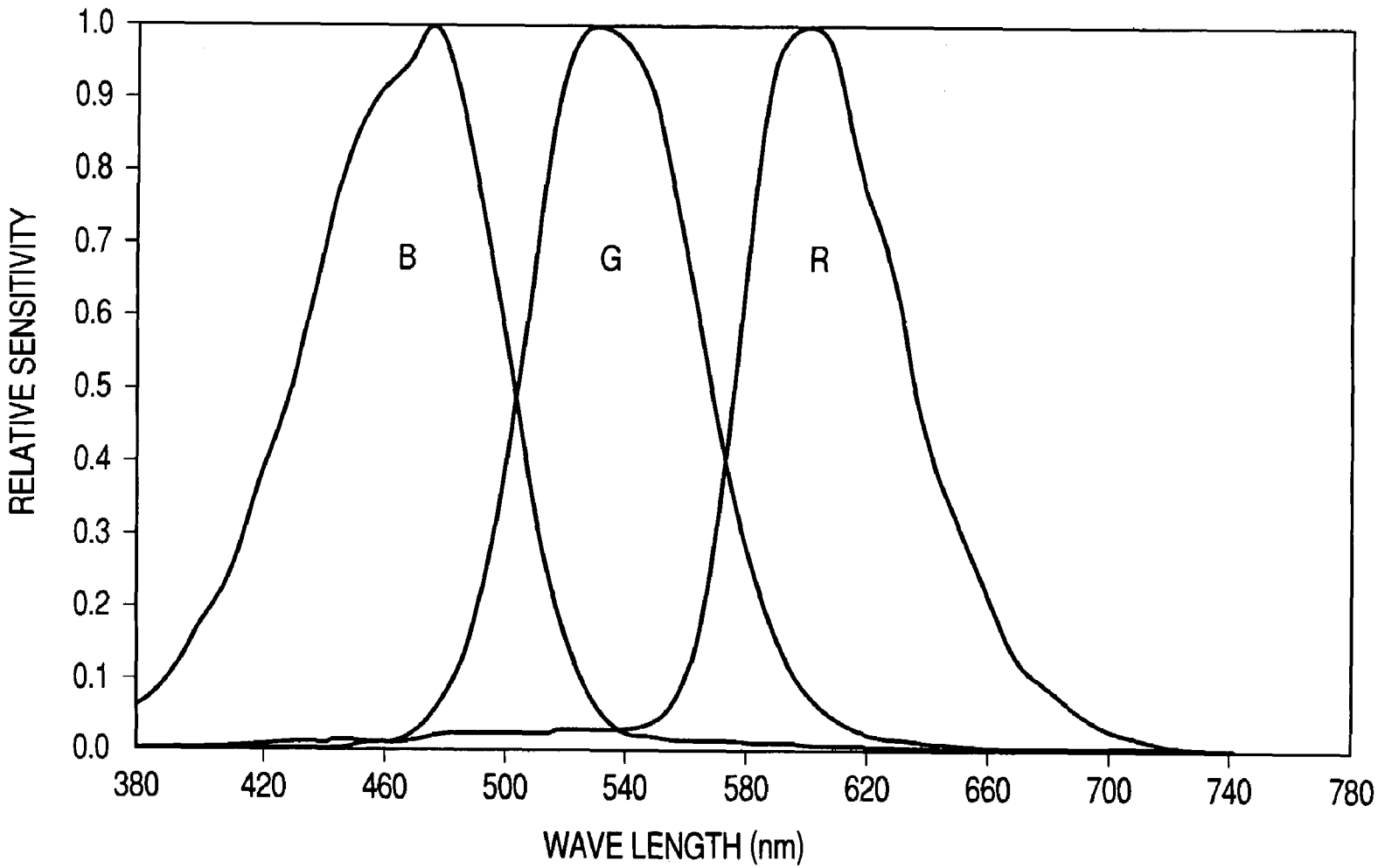
FIG. 5 is a view showing a spectral filter characteristic of the density detection sensor.
Figure 6:
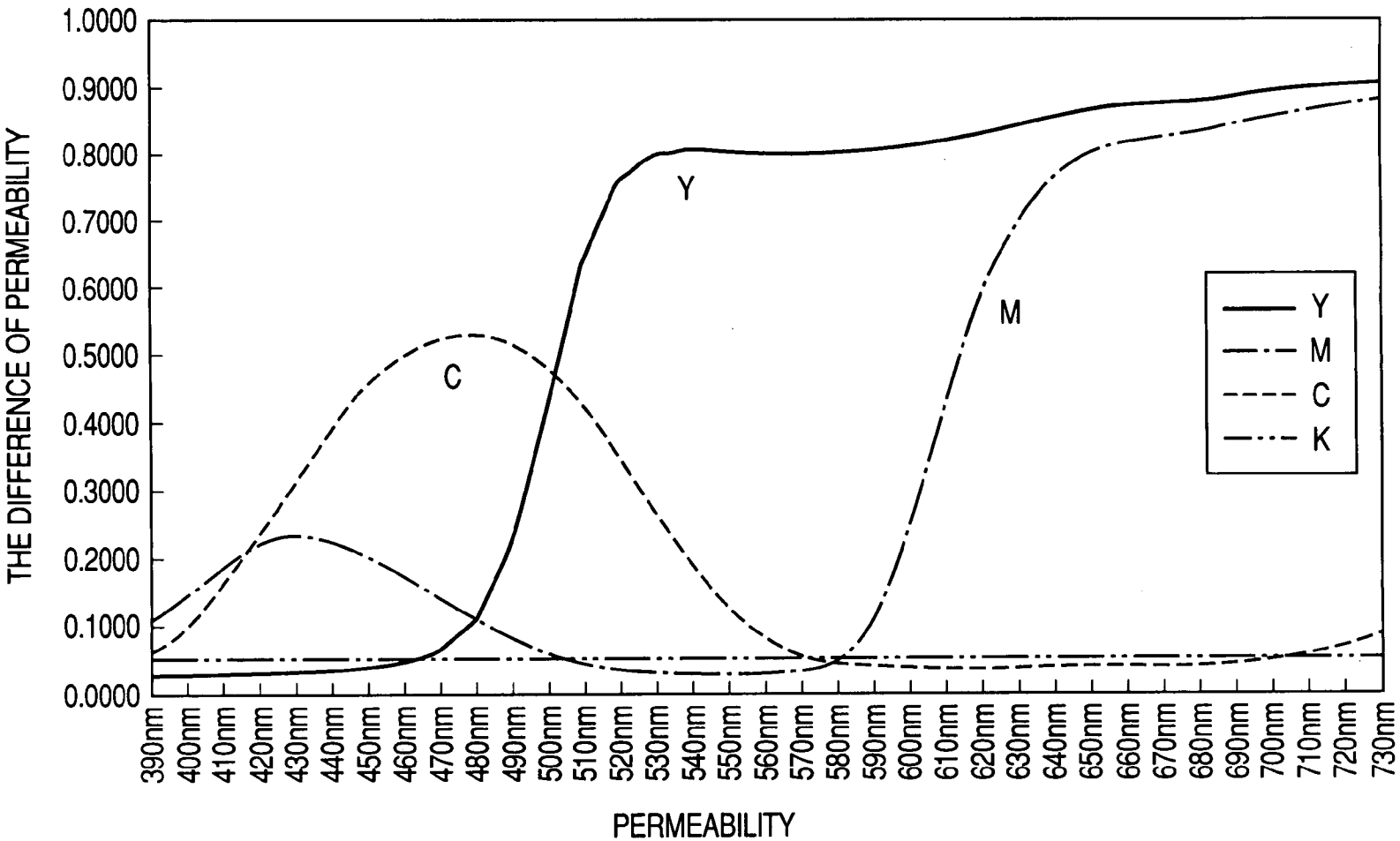
FIG. 6 is a view showing a spectral reflectance characteristic of a toner.

FIG. 5 shows a typical spectral characteristic of the color separation filter of the density detection sensor 40 used in the present embodiment. Further, FIG. 6 shows a spectral reflection factor of each color toner Y, M, C and K used in the present embodiment.

The light irradiated from the light source 41 is reflected by the patches P (1 to 4) fixed and mixed on the intermediate transferring belt 30, and enters the light receiving element 42 through color separation filters 43R, 43G, and 43B of each color.

Here, as an example, it is when the density of each image is highest at 1.45 that the difference of the magenta toner amount becomes the highest in the single color magenta M image and plural color red R images on the intermediate transferring belt 30 by the re-transferring of the toner from the intermediate transferring belt 30 side to the photosensitive drum 17 side in the primary re-transferring process. Further, the magenta toner amount on the intermediate transferring belt 30 at that time after the primary-transferring process of a black K image is 0.60 mg/cm$^2$.

Further, the output voltage of the density detection sensor 40 is outputted at 0 to 5 V. The outputted voltage is AD-converted so that the density of 0 to 2.0 is turned into 10 bits (0 to 1023 levels).

In the present embodiment, as a reference, the single color patch P1 (equivalent to the density level 742 and the density 1.45 of the M image, and the magenta toner amount on the intermediate transferring belt 30*a* after the primary transfer of the black image K is 0.60 mg/cm$^2$) and the single color yellow patch P2 (equivalent to the density 1.45) are formed, and with the image forming condition kept as it is, the formation of P3 (R patch) and P4 (G patch) are performed. The control circuit CPU 100, based on input detection color information from the density detection sensor 40, performs a comparison of the density level of the magenta M image in the patch P1 and the density level of the magenta M in the patch P3, and a comparison of the density level of the yellow Y in the patch P2 and the density level of the yellow Y in the patch P4, and based on that result, the control means CPU 100 performs a control of the primary-transferring condition applied to the primary-transferring charging roller 31 from the high voltage output circuit E1 at each primary-transferring time of yellow Y, cyan C and black K in the next full color image forming process. Further, the control means CPU 100 calculates a re-transferring amount in the control process. (Color taste adjustment mode).

To be specific, in case the re-transferring amount of the magenta toner exceeds 0.09 mg/cm$^2$, the primary transfer target current value of yellow Y, cyan C, and black K is reduced by 5 μA. In case the re-transferring amount of the yellow toner exceeds 0.09 mg/cm$^2$, the primary transfer target current value of cyan C and black K is reduced by 5 μA. Here, the re-transferring amount 0.09 mg/cm$^2$ of the magenta toner is referred to when a M density level P3M in P3 (R patch) becomes a high value of equal to or more than 148 for a M density level P1M (value in the vicinity of 742) of the magenta M patch P1 of the single color as a reference. The value 0.09 mg/cm$^2$ of yellow is equivalent to 100 of a Y density level. Here, the value 0.09 mg/cm$^2$ as a tolerance level of the re-transferring amount is approximately 0.2 shown by a reflection density, and is a standardized value of a deflection width of the density in the present embodiment.

Figure 8:
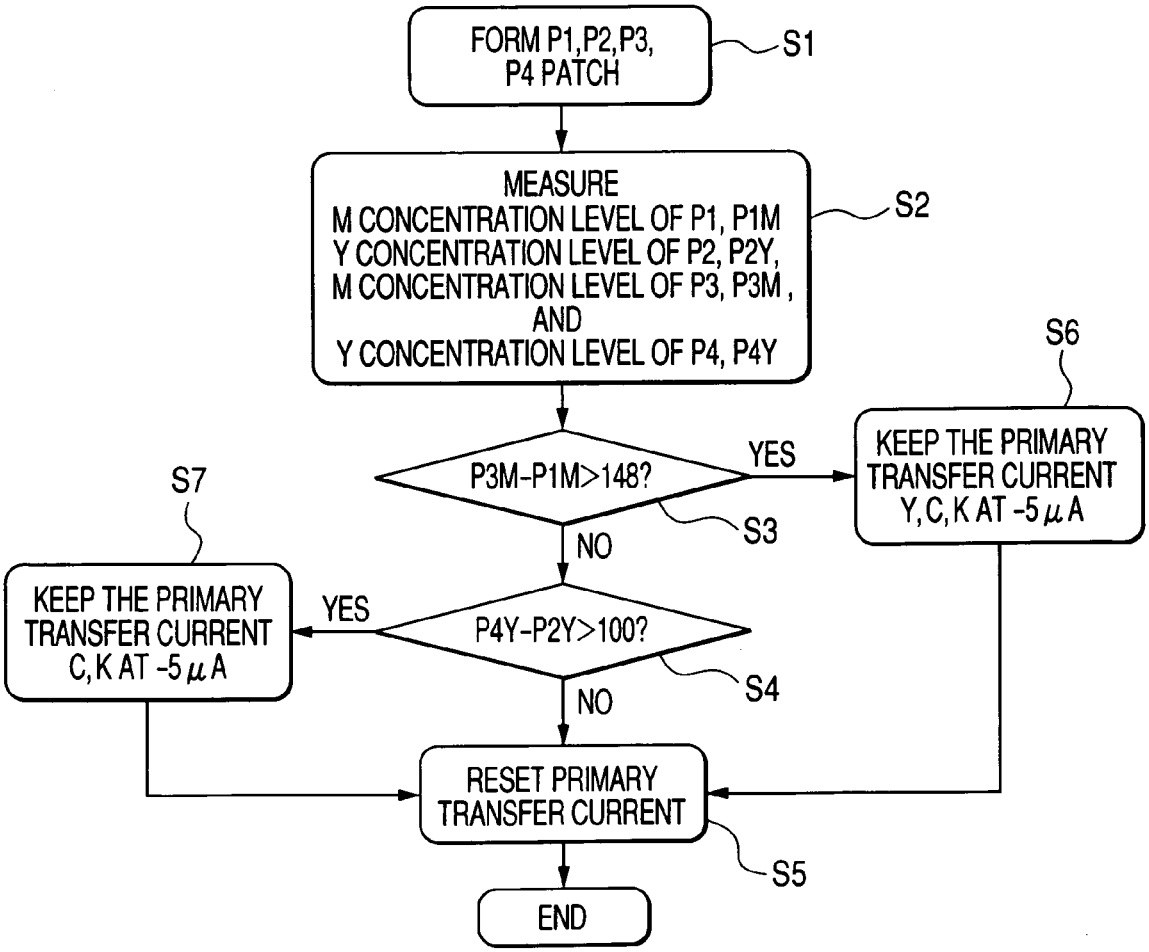
FIG. 8 is a flowchart showing the control of a primary transfer parameter.

FIG. 7 is a block diagram of a control circuit system for executing the color taste adjustment mode. FIG. 8 shows a flowchart of the control content of the color taste adjustment mode.

Now, assuming that the circumstantial moisture amount is 8.57 g/Kg, the target primary-transferring current values of yellow, cyan, and black are 95 μA, 95 μA, and 62 μA, respectively. Here, in case the re-transferring amount of the magenta toner exceeds 0.09 mg/cm$^2$, that is, in case the difference (P3M-P1M) between the magenta M patch density level P1M and the M density level P3M in P3 (R patch) is larger than 148, the primary-transferring currents (current applied to the primary-transferring roller 31) of yellow, cyan and black are uniformly subtracted by −5 μA, thereby taking each primary-transferring current value as 90 μA, 90 μA, and 57 μA. Further, in case (P3M-P1M) is not larger than 148, but the difference (P4Y-P2Y) between the Y density level of the yellow Y patch P2 and the Y density level P4Y in P2Y and P4 (G patch) is larger than 100, then, the primary-transferring currents of cyan and black are uniformly subtracted by −5 μA, thereby making them as 90 μA and 57 μA.

Figure 9:
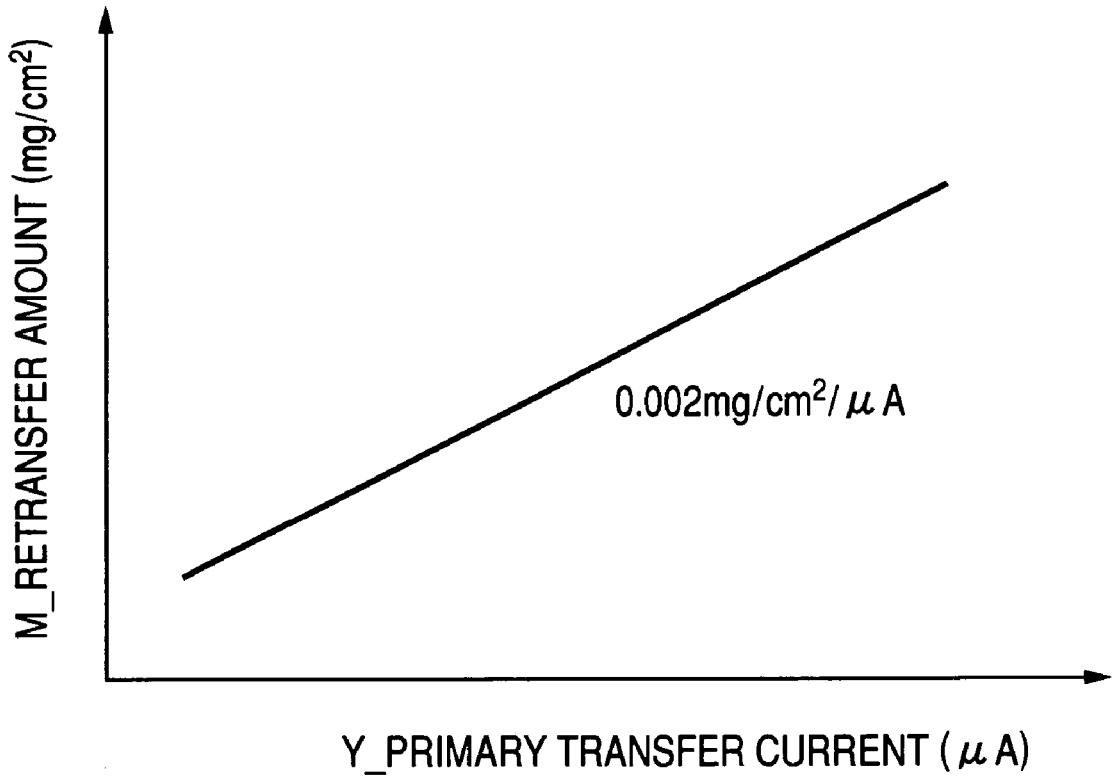
FIG. 9 is a view showing a relation between the primary transfer current value and a re-transferring amount.

Further, FIG. 9 shows a relation between the primary-transferring current value and the re-transferring amount in the apparatus of the present embodiment, and shows, for example, a relation between the M toner amount on the intermediate transferring belt 30 after the primary transfer of the black image K and the primary-transferring current value of the yellow toner image Y in case a M single color image of the magenta M toner amount 0.60 mg/cm$^2$ is formed on the photosensitive drum 17. By reducing the primary-transferring current value of the yellow toner image Y by 5 μA, the re-transferring amount of the magenta toner M is improved approximately by 0.01 mg/cm$^2$. Further, this relation holds true also with the primary-transferring current value of the cyan toner image C and the primary-transferring current value of the black toner image K, and in the present embodiment, the primary-transferring current value of each color toner image of yellow Y, cyan C and black K is simultaneously reduced by 5 μA, so that a control for improving the re-transferring amount approximately by 0.03 mg/cm$^2$ is performed.

Here, by reducing the primary-transferring current value of the toner image of each color of yellow Y, cyan C, and black K, though there is a possibility of the influence on transferring properties of secondary colors (R, G, and B), an increase of the re-transferring amount occurs when the charge amount of the toner drops, and the transferring properties of the secondary colors tend to be improved when the charge amount drops, and therefore, the above described control is established to a sufficiently possible extent.

Each patch P1 to P4 on the intermediate transferring belt 30*a* after the color density detection by the density detection sensor 40 is borne to a position of the cleaner 62 by the continuous rotation of the intermediate transferring belt 30*a*, and is removed from above the intermediate transferring belt 30*a* by the cleaner 62.

As described above, the toner patches of P1, P2, P3 and P4 of the single color and plural colors are fixed and mixed on the intermediate transferring belt 30, and information on each color of respective toner patches is detected so that a correction is added to the primary parameter, and the problem of a color taste deviation is solved, which is not achievable by the conventional single color control and plural color control.

In the present embodiment, the re-transferring amount is calculated based on the difference of colors between the density of the single color toner image and the single color toner image in the mixed toner images, thereby controlling the primary-transferring condition. However, the present embodiment is not limited to this method, but by measuring the density of the color of the single color toner image in the mixed toner images, and comparing this density to the value decided in advance, the primary-transferring condition can be also controlled.

Further, in the present embodiment, though the primary-transferring target current is controlled so as to correct the primary-transferring parameter, the control is not limited to this, but the primary-transferring bias can be also directly controlled.

Second Embodiment

Figure 10:
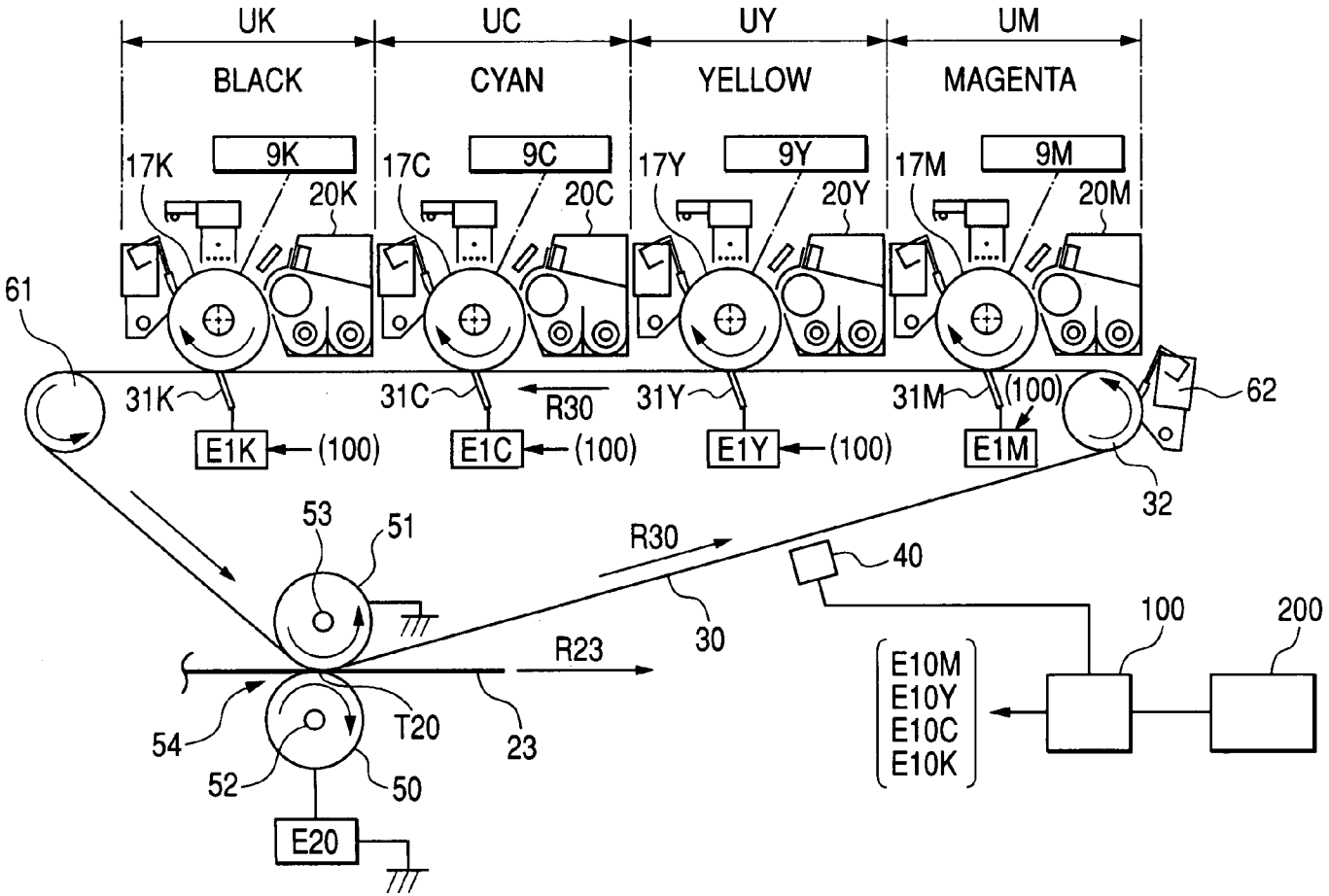
FIG. 10 is a schematic block diagram of the image forming apparatus of a second embodiment.

FIG. 10 is a vertical section showing a general structure of the image forming apparatus in a second embodiment. The component members and parts common to the image forming apparatus of the first embodiment will be attached with common reference numerals and a duplicative description thereof will be omitted.

The image forming apparatus of the present embodiment is a four color full color image forming apparatus of a tandem system in which electrophotographic photosensitive members as image bearing members of the same number of colors required for an image, and charging means, image exposing means, and developing means are provided in the vicinity of each electrophotographic photosensitive member, and the toner images of a single color formed on each electrophotographic photosensitive member are superposed in order on an intermediate transferring member (transferring medium) and are primary-transferred, so that color toner images composed by overlaying each color toner image on the intermediate transferring member are synthetically formed, and these color toner images synthetically formed are collectively secondary-transferred on a transferring material from above the intermediate transferring member by a transferring fixing apparatus (fixing means), and at the same time, are fixed and mixed, thereby obtaining a full color image formative matter.

Figure 11:
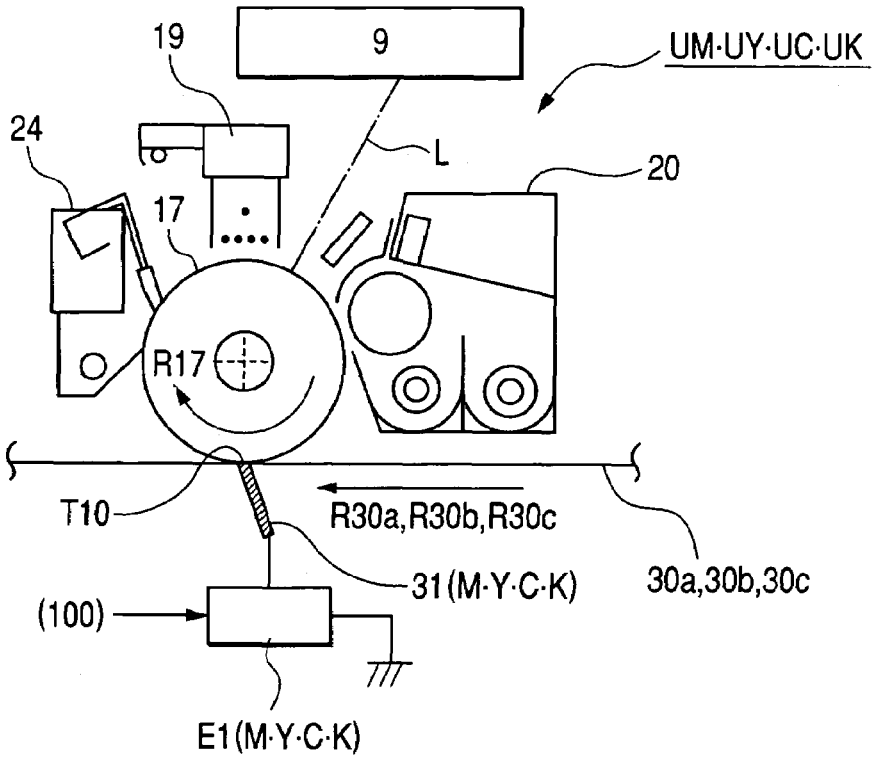
FIG. 11 is a vertical section showing a schematic structure of an image forming unit.

That is, this image forming apparatus comprises four sets of the first to the fourth image forming units UM, UY, UC, and UK disposed in order from the right to the left in the drawing. FIG. 11 is an enlarged view of a unit from among those image forming units. Each of the image forming units UM, UY, UC, and UK is basically of the same electrophotographic process mechanism, and comprises an electrophotostatic process equipment and the like such as a photosensitive drum 17 (image bearing member) as an image bearing member rotationally driven clockwise in the direction of an arrow mark R17 at a predetermined peripheral velocity, a primary charging device 19 for uniformly charging the surface of the photosensitive drum 17 to a predetermined polarity and potential, an exposing apparatus 9 such as a laser scanner and the like for exposing a light figure L on the uniformly charged surface of the photosensitive drum 17 so as to write and form an electrostatic image, a developing apparatus 20 for developing the electrostatic latent image as a toner image, a primary-transferring charging device 31 for transferring that toner image on an intermediate transferring belt 30*a* (transferring medium) in a primary-transferring portion T1, and a cleaner 24 for cleaning the surface of the photosensitive drum 17 after the transferring of the toner image on the intermediate transferring belt 30*a*.

The first image forming unit UM stores a magenta toner (first toner) as a developer in a developing apparatus 20M (first toner image forming means), and forms a magenta toner image (first toner image) on a photosensitive drum 17M (first image bearing member). The second image forming unit UY stores a yellow toner (second toner) as a developer in a developing apparatus 20Y (second toner image forming means), and forms a yellow toner image (second toner image) on a photosensitive drum 17C (second image bearing member). The third image forming unit UC stores a cyan toner as a developer in a developing apparatus 20C, and forms a cyan toner image on the photosensitive drum 17C. The fourth image forming unit UK stores a black toner as a developer in a developing apparatus 20K, and forms a black toner on a photosensitive drum 17K.

The intermediate transferring belt (transferring medium) 30*a* has a belt portion of the ascending side run across the underside of the photosensitive drum 17 of each image forming unit located at the bottom of the first to fourth image forming units UM, UY, UC, and UK so as to allow the belt portion to span and stretch among three spanning rollers of a driving roller 32, a tension roller 61, and a fixing portion opposed roller 51 of the transferring fixing apparatus 54. The intermediate transferring belt 30*a* is rotationally driven counter-clockwise in the direction of an arrow mark R 30*a* by the rotational driving of the driving roller 32 approximately at the same peripheral velocity as the rotational peripheral velocity of the photosensitive drum 17.

The primary charging devices 31M (first transferring means), 31Y (second transferring means), 31C, and 31K in each of the first to fourth image forming units UM, UY, UC, and UK are conductive blades in the present embodiment, and are disposed at the rear side (internal side) of the intermediate transferring belt 30*a*, respectively, and are compressed to the undersurface of the corresponding photosensitive drum 17 through the ascending side belt portion (belt portion between the driving roller 32 and the tension roller 61) of the intermediate transferring belt 30*a*, and form a primary-transferring portion T1 (nip portion) between the photosensitive drum 17 and the surface (outer surface side) of the intermediate transferring belt 30. Each of an E1M, an E1Y, an E1C, and an E1K is a high voltage output circuit (bias applied power source, power source) for the primary-transferring charging devices 31M, 31Y, 31C and 31K.

Reference numeral 50 is a fixing roller, and is compressed to the fixing portion opposed roller 51 through the intermediate transferring belt 30*a*, and forms a secondary simultaneous transferring and fixing portion (nip portion) T2 with the surface of the intermediate transferring belt 30*a*. This fixing roller 50 and the fixing portion opposed roller 51 constitute a transferring fixing apparatus (fixing means) 54 as a second transferring means. The constitution of this transferring fixing apparatus is the same as the transferring fixing apparatus 54 in the first embodiment. Reference numeral E2 denotes a high voltage output circuit (bias applied power source) for the fixing roller 50.

Reference numeral 62 is a cleaner, which is disposed by being abutted against the surface (outer surface) of the intermediate transferring belt 30 in an intermediate transferring belt winding portion of the driving roller 32. In the present embodiment, this cleaner 62 is a blade type cleaner.

Reference numeral 40 denotes a density detection sensor (detecting means), which is disposed by opposing non-contact to the intermediate transferring belt surface (toner image transferred surface) between the upstream side of the moving direction of the intermediate transferring belt from a driving roller 32 and the downstream side in the moving direction of the intermediate transferring belt from the fixing portion opposed roller 51 of the transferring fixing apparatus 54.

A full color image forming operation is as follows. The first to fourth image forming units UM, UY, UC, and UK are driven in order in the exact timing with the image formation. Further, the intermediate transferring belt 30*a* is also rotationally driven. The surface of the photosensitive drum 17 of the first image forming unit UM is formed with a toner image of a magenta component of the full color image, the surface of the photosensitive drum 17 of the second image forming unit UY is formed with a toner image of a yellow component of the full color image, the surface of a photosensitive member 11 of the third image forming unit C is formed with a toner image of a cyan component of the full color image, and the surface of the photosensitive member 11 of the fourth image forming unit K is formed with a toner image of a black component of the full color image at a predetermined timing, respectively.

The yellow toner image, the magenta toner image, the cyan toner image, and the black toner imager formed on the photosensitive drums 17 of each image forming units UM, UY, UC, and UK are superposingly transferred in order on the surface of the intermediate transferring belt 30*a* in the primary-transferring portion T1 of the image forming unit, and an unfixed full color toner image is synthetically formed on the intermediate transferring belt 30*a*.

In each of the first to fourth image forming units UM, UY, UC, and UK, the bias apply to the primary charging devices 31M, 31Y, 31C, and 31K from the high voltage output circuits E1M, E1Y, E1C, and E1K at the primary-transferring time from above the photosensitive drum 17 to above the intermediate transferring belt 30*a*, similarly to the image forming apparatus of the first embodiment, performs a constant voltage control, and is controlled so that the primary-transferring current is allowed to flow along the target current. The primary-transferring current let flow along the target current is variably controlled by a control circuit CPU (control means) 100 based on a circumstantial moisture amount obtained from the measurement result of a temperature sensor 200 which measures temperature and humidity inside the image forming apparatus.

In a predetermined timing with the conveyance of the four color superposed toner images to the secondary transferring portion T20 by the continuous rotation of the intermediate transferring belt 30 and the arrival of the top end portions of those toner images at the secondary transferring portion T2, the transferring material 23 is fed from a sheet feeding apparatus (not shown) so that the top end portions similarly reach the secondary transferring portion T20. Further, an applied bias to the fixing roller 50 from the high voltage output circuit E2 is switched from the same polarity bias as the toner charging polarity to a reverse polarity bias. In this manner, the four color superposed toner images on the intermediate transferring belt 30*a* are collectively transferred in order on the transferring material 23 in the secondary transferring portion T20, and at the same time, are heated and fixed (fixing mixture), and a full color image formative matter is discharged outside of the image forming apparatus.

The toner (residual toner) remained on the surface of the intermediate transferring belt 30*a*, which is not transferred on the transferring material 23 in the secondary transferring portion T20, is brushed off by the blade of the cleaner 62, and is removed, and the intermediate transferring belt 30*a* is repeatedly provided for image formation.

In the image forming apparatus of the present embodiment also, similarly to the image forming apparatus of the first embodiment, in the preliminary operating process of the image forming apparatus, the patches of the single color and plural colors are overlaid on the intermediate transferring belt 30*a*, and are fixed and mixed on the intermediate transferring belt 30*a* without allowing the transferring material 23 to be fed to the secondary transferring portion T20, and the color density of those toner images are detected by the density detection sensor 40 as detection means, and based on the detection result, a color taste adjustment mode is provided for controlling the primary-transferring condition (the primary-transferring current or the primary-transferring bias) of each of the first to fourth image forming units UM, UY, UC, and UK in the color image forming process to be executed next time.

In the image forming apparatus in the present embodiment also, similarly to the image forming apparatus of the first embodiment, in the preliminary rotational process of the image forming apparatus, the patches P1, P2, P3, and P4 shown in FIG. 3 are formed on the intermediate transferring belt 30*a*.

The forming method of these patches is as follows.

An electrostatic image formed on the photosensitive drum 17M (first image bearing member) is developed by a magenta developing device 20M (first toner image forming means) by using a magenta toner (first toner), so that a magenta toner image (first toner image) is formed at a position where the patches P1 and P2 are formed. This magenta toner image is transferred on the intermediate transferring belt (transferring medium) 30*a* by a primary-transferring charging device 31M (first transferring means).

Subsequently, the electrostatic image formed on the photosensitive drum 17Y (second imager bearing member) is developed by a yellow developing device 20Y (second toner image forming means) by using a yellow toner (second toner). A yellow toner image (the second toner image) is formed in the position where the patches P2, P3 and P4. That is, the yellow toner image as the second toner image is transferred on the intermediate transferring belt 30*a* by the primary-transferring charging device 31Y (second primary-transferring means) so as to be overlaid on a portion of the magenta toner image (here P3) as the first toner image. Further, the yellow toner image is transferred on the intermediate transferring belt 30*a* by the primary-transferring charging device 31Y (second transferring means) so as not to be overlaid on a portion (here P1) of the magenta toner image.

The yellow toner image and magenta toner image transferred on the intermediate transferring belt 30*a* are fixed and mixed on the intermediate transferring belt 30*a* without allowing the transferring material 23 to be fed to the secondary transferring portion T20, and a patch P3 (mixed toner image) of red is formed on the intermediate transferring belt 30*a*.

Further, in the magenta toner image, a portion which is transferred but not overlaid with other color toner images is fixed on the intermediate transferring belt 30*a* without being mixed with other color toner images, and a patch P1 (single color toner image) of magenta is formed on the intermediate transferring belt 30*a*.

In the yellow toner image, a portion which is transferred but not overlaid with other color toner images is fixed on the intermediate transferring belt 30*a* without being mixed with other color toner images, and a yellow patch P2 (single color toner image) is formed on the intermediate transferring belt 30*a*.

Similarly, after the cyan toner image is transferred so as to be overlaid on the yellow toner image on the intermediate transferring belt 30*a*, the cyan toner image is fixed and mixed on the intermediate transferring belt 30*a* without allowing the transferring material 23 to be fed to the secondary transferring portion T20, and a patch P4 (single color toner image) is formed.

In the color taste adjustment mode in the present embodiment also, the color taste of P1 and P2 which are the patches (single color toner images) of the single color and P3 and P4 which are the patches fixed and mixed with the patches (mixed toner images) of plural colors formed on the transferring material 23 are detected by the density sensor 40*a*. These detection procedures are the same as the detection procedures of the first embodiment (see FIGS. 7 and 8).

Figure 12:
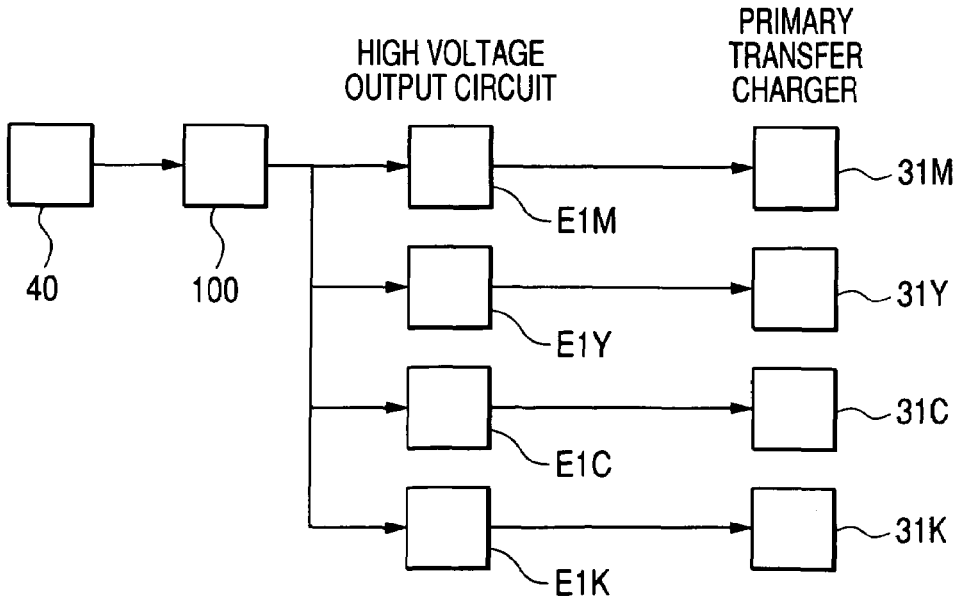
FIG. 12 is a block diagram of the control circuit system for executing the color taste adjustment mode.

In the present embodiment also, similarly to the control of the first embodiment, when the difference between the magenta density of the single color patch (for example, the magenta toner patch) and the magenta density of the patch fixed and mixed with the patches (for example, the patch fixed and mixed with the magenta toner patch and the yellow toner patch) of plural colors becomes equal to or more than a predetermined value, that is, when the re-transferring amount of the magenta toner becomes equal to or more than a predetermined amount, a control circuit CPU100 reduces primary-transferring target currents of cyan, yellow, and black by 5 μA. Further, when the difference between the yellow density of the yellow toner patch and the yellow density of the patch fixed and mixed with the yellow toner patch and the cyan toner patch becomes equal to or more than a predetermined value, the control circuit CPU 100 reduces the primary target currents of cyan and black by 5 μA. A block diagram of the color taste adjustment mode of the present embodiment is shown in FIG. 12.

In this manner, in the image forming apparatus of the present embodiment also, the problem of a color taste deviation is solved.

In the present embodiment, the re-transferring amount is calculated based on the difference between the density of the single color toner image and the single color toner image in the mixed toner images, thereby controlling the primary-transferring condition. However, the present embodiment is not limited to this method, but by measuring the density of the color of the single color toner image in the mixed toner images, and comparing this density to the value decided in advance, the primary-transferring condition can be also controlled.

In the present embodiment, though the color taste adjustment mode is executed in the preliminary rotational operating process, similarly to the first embodiment, in the rotational process after the completion of one job, and further in the case of the job of the large quantity of sheets in succession, the color adjustment mode can be executed also once for several hundreds sheets. Further, the user can execute the color taste adjustment mode at his discretion.

Others

1) In each of the image forming apparatus of the first and second embodiments, the image forming process using the developing apparatus storing the black toner only is performed or the fourth image forming unit UK forming the black toner image only is operated at a monochrome image forming time.

2) In each of the image forming apparatus of the first and second embodiments, the intermediate transferring member 30 as the second image bearing member is not limited to an endless belt member, but a drum-shape member can be also adopted.

3) The image forming principle and process of the image forming apparatus are not limited to an electrophotographic process, but may be an electrostatic recording process and an electromagnetic recording process and the like.

Third Embodiment

Figure 13:
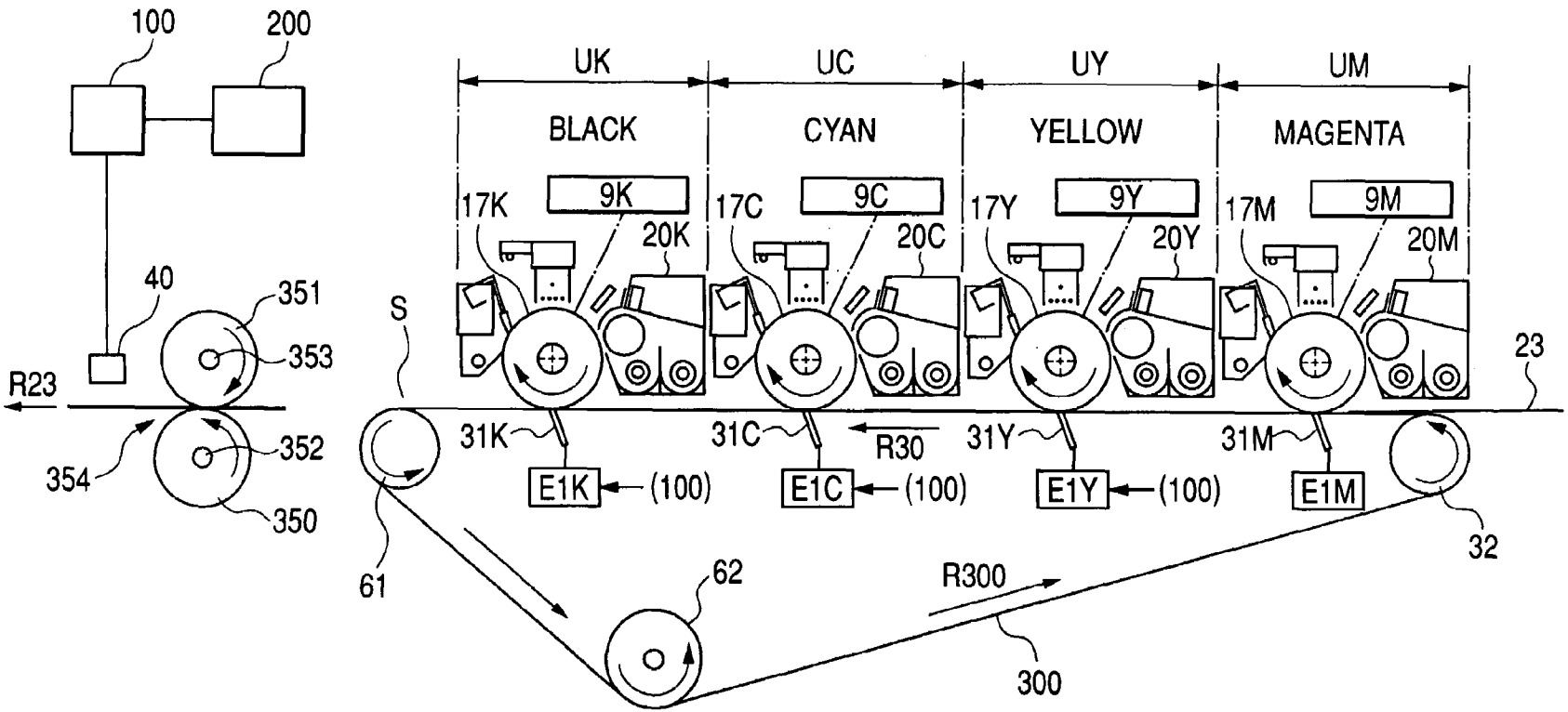
FIG. 13 is a schematic block diagram of the image forming apparatus of a third embodiment.

FIG. 13 is a vertical section showing a schematic block diagram of an image forming apparatus in a present third embodiment. The component members and parts common to the image forming apparatus of the first and second embodiments will be denoted with common reference numerals, and a description thereof will be omitted.

The image forming apparatus of the present embodiment is a four color full color image forming apparatus of a tandem system in which single color toner images formed by photosensitive drums 17M, 17Y, 17C, and 17K of image forming units UM, UY, UC, and UK are superposed in order on a transferring material conveyed by a transferring material conveying belt so that color toner images composed by overlaying of each color toner image on the transferring material are synthetically formed, and are fixed and mixed by a fixing apparatus, thereby obtaining a full color image formative matter.

This image forming apparatus comprises the image forming units UM, UY, UC, and UK having the same constitution as the image forming units of the second embodiment. The constitution of each image forming unit is as shown in FIG. 11.

A transferring material 23 fed from a sheet feeding apparatus (not shown) to a transferring material conveying belt 300 is absorbed in the transferring material conveying belt 300 by absorbing means (not shown), and is conveyed by the transferring material conveying belt 300.

Each image forming unit comprises a photosensitive drum 17 (image bearing member) rotationally driven clockwise in the direction of an arrow mark R17 at a predetermined peripheral velocity, a primary charging device 19 for uniformly charging the surface of the photosensitive drum 17 to predetermined polarity and potential, an exposing apparatus 9 for forming an electrostatic image as a light figure exposure L on the uniformly charged surface of the photosensitive drum 17, a developing apparatus (toner image forming means) 20 for developing an electrostatic latent image as a toner image by the toner, transferring charging devices (transferring means) 31M, 31Y, 31C, and 31K for transferring the toner image to a transferring material 23 carried by the transferring material conveying belt 300 in a transferring portion T12, a fixing device (fixing means) 354 for fixing and mixing the toner image to the transferring material, and the like.

The first image forming unit UM develops the electrostatic image formed on a photosensitive drum 17M (first image bearing member) by a magenta developing device 20M (first toner image forming means) by using a magenta toner (first toner), and a magenta toner image (first toner image) is formed on the photosensitive drum 17M.

The second image forming unit UY develops the electrostatic image formed on a photosensitive drum 17Y (second image bearing member) by a yellow developing device 20Y (second toner image forming means) by using a yellow toner (second toner), and a magenta toner image (second toner image) is formed on the photosensitive drum 17Y.

Similarly, the third image forming unit UC has a cyan toner image formed on a photosensitive drum 17C. The fourth image forming unit UK has a black toner image formed on a photosensitive drum 17K.

The transferring material conveying belt 300 has a belt portion of the ascending side run across the underside of the photosensitive drum 17 of each image forming unit located at the bottom of the first to fourth image forming units UM, UY, UC, and UK so as to allow the belt portion to span and stretch among three spanning rollers of a driving roller 32, a tension roller 61, and an idle roller 62.

The transferring material conveying belt 300 is rotationally driven counter-clockwise in the direction of an arrow mark R 300 by the rotational driving of the driving roller 32 approximately at the same peripheral velocity as the rotational peripheral velocity of the photosensitive drum 17. The transferring material 23 is conveyed approximately at the same velocity as the rotational velocity of the photosensitive drum 17 accompanied with the rotation of the transferring material conveying belt 300.

The transferring charging devices 31M, 31Y, 31C, and 31K in each of the first to fourth image forming units UM, UY, UC, and UK are disposed at the rear side (internal side) of the intermediate transferring belt 300, respectively, and are compressed to the undersurfaces of the corresponding photosensitive drums 17M, 17Y, 17C, and 17K through the ascending side belt portion (belt portion between the driving roller 32 and the tension roller 61) of the intermediate transferring belt 300, and form a transferring portion T1 (nip portion) between the photosensitive drum 17 and the surface (outer surface side) of the transferring material conveying belt 300. Each of an E1M, an E1Y, an E1C, and an E1K is a high voltage output circuit (bias applied power source, power source) for the primary-transferring charging devices 31M, 31Y, 31C and 31K.

When the current is applied to the transferring charging device 31M (first transferring means) which is opposed to the photosensitive drum 17M from a high voltage output circuit (power source) E1M, the magenta toner image formed on the photosensitive drum 17M of the first image forming unit UM is transferred on the transferring material 23 which is conveyed by the transferring material conveying belt 300.

When the current is applied to the transferring charging device 31Y (second transferring means) which is opposed to the photosensitive drum 17Y from a high voltage output circuit (power source) E1Y, the yellow toner image formed on the surface of the photosensitive drum 17Y of the second image forming unit UY is transferred on the transferring material 23 which is conveyed by the transferring material conveying belt 300.

Similarly, the cyan and black toner images are transferred on the transferring material 23 conveyed to the transferring material conveying belt 300 from the third and fourth image forming units UC and UK.

A fixing apparatus 354 has a fixing roller 351 provided at the side to contact a color toner image and a pressure roller 350 at the opposite side. The inner spaces of the fixing roller 351 and the pressure roller 350 are disposed with halogen heaters 353 and 352 as heating means, respectively. Similarly to the transferring fixing apparatus 54 of the first embodiment, the surfaces of the fixing roller 351 and the pressure roller 350 are disposed with temperature control thermistors (not shown), respectively, and ON/OFF controls the halogen heaters 353 and 352 by the temperature information from the thermistors, and controls the temperatures of the fixing roller 351 and pressure roller 350 to a predetermined level. In the present embodiment, the temperature is controlled to become 150° C. Further, the surface of the fixing roller 351 is coated with PFA which is a good mold releasing fluorine contained resin, thereby preventing toner adherence to the fixing roller.

Reference numeral 40 denotes a density detection sensor (detecting means) for detecting a toner image fixed on the transferring material, and is disposed by opposing without contacting to the transferring material in the downstream side of the fixing apparatus 354 in the advancing direction (arrow mark R23) of the transferring material.

A full color image forming operation is as follows.

The first to fourth image forming units UM, UY, UC, and UK are driven in order in the exact timing with the image formation. Further, the intermediate transferring belt 300 is also rotationally driven.

The surface of the photosensitive drum 17 of the first image forming unit UM is formed with a toner image of a magenta component of the full color image, the surface of the photosensitive drum 17 of the second image forming unit UY is formed with a toner image of a yellow component of the full color image, the surface of a photosensitive member 11 of the third image forming unit C is formed with a toner image of a cyan component of the full color image, and the surface of the photosensitive member 11 of the fourth image forming unit K is formed with a toner image of a black component of the full color image at a predetermined timing, respectively.

Further, in a predetermined timing, the transferring material 23 is fed to the transferring material conveying belt 300, and is electrostatically absorbed in the transferring material conveying belt 300 by absorbing means (not shown). The transferring material 23 absorbed in the transferring material conveying belt 300 is conveyed by the transferring material conveying belt 300.

The yellow toner image, the magenta toner image, the cyan toner image, and the black toner image formed on the photosensitive drum 17 of each image forming unit UM, UY, UC, and UK are superposedly transferred in order in a positioning state on the surface of the transferring material 23 which is conveyed by the transferring material conveying belt 300 in the transferring portion T1, thereby synthetically forming an unfixed full color toner image on the transferring material 23.

In each of the first to fourth image forming units UM, UY, UC, and UK, a bias apply from the high voltage output circuits E1M, E1Y, E1C, and E1K to the transferring charging devices 31M, 31Y, 31C, and 31K at the transferring time from above the photosensitive drum 17 to above the transferring material conveying belt 300, similarly to the first embodiment, is subjected to a constant voltage control, and is controlled so that a primary-transferring current is let flow along a target current. In the present embodiment, in a state in which the transferring material 23 is not absorbed in the transferring material conveying belt 300, the constant voltage control is performed, and in consideration of the electric resistance value of the transferring material 23, a voltage in which the current of 150 percent of the target current is allowed to flow is found, and when the toner image is transferred on the transferring material 23, a voltage, which is constant voltage controlled toward the transferring charging device 31, is applied.

The primary-transferring current which is let flow along the target current is variably controlled by a control circuit CPU (control means) 100 based on a circumstantial moisture amount obtained from the measuring result of an environmental sensor 200 which measures temperature and moisture inside the image forming apparatus.

The transferring material 23 on which the toner image is transferred is electrostatically separated from the transferring material conveying belt 300 at a separation position S by a separation charging device (not shown).

The transferring material 23 separated from the transferring material conveying belt 300 is conveyed to the fixing apparatus 354 by conveying means (not shown). The toner image is fixed and mixed on the transferring material 23, and a full color image formed material is discharged outside of the image forming apparatus.

The image forming apparatus of the present embodiment comprises a color taste adjustment mode, which detects the patches of a single color and plural colors formed on the transferring material 23 and variably controls a transferring condition.

In the image forming apparatus of the present embodiment also, in the preliminary rotational operating process of the image forming apparatus, the patches P1, P2, P3, and P4 shown in FIG. 3 are formed on the transferring material 23.

The forming method of these patches is as follows.

An electrostatic image formed on the photosensitive drum 17M (first image bearing member) is developed by a magenta developing device 20M (first toner image forming means) by using a magenta toner (first toner), so that a magenta toner image (first toner image) is formed at a position where the patches P1 and P3 are formed. This magenta toner image is transferred on the transferring material 23 (transferring medium) conveyed on the transferring material conveying belt (transferring medium) 300 by a primary-transferring charging device 31M (first transferring means).

Subsequently, the electrostatic image formed on the photosensitive drum 17Y is developed by a yellow developing device 20Y (second toner image forming means) by using a yellow toner (second toner), so that a yellow toner image (second toner image) is formed at a position where the patches P2, P3, and P4 are formed. That is, the yellow toner image as the second toner image is transferred on the transferring material 23 conveyed on the transferring material conveying belt 300 by a primary-transferring charging device 320Y (second primary-transferring means) so as to be overlaid on a portion (here P3) of the magenta toner image as the first toner image. Further, the yellow toner image is transferred on the transferring material 23 conveyed on the transferring material conveying belt 300 by the transferring charging device 31Y (second transferring means) so as not to be overlaid on a portion (here P1) of the magenta toner.

Subsequently, the transferring material 23 on which the toner image is transferred is separated from the transferring material conveying belt 300, and is conveyed to the fixing apparatus 354.

In the portion overlaid with the magenta toner image and the yellow toner image, the magenta toner image and the yellow toner image are fixed and mixed by the fixing apparatus 354, and the patch P3 (mixed toner image) of red is formed on the transferring material 23.

Further, in the magenta toner image, the portion which is not overlaid with the toner image of other colors but transferred is fixed on the transferring material 23 by the fixing apparatus (fixing means) 354 without being mixed with the toner image of other colors, and the patch P1 (single color toner image) of magenta is formed on the transferring material. In the yellow toner image, the portion which is not overlaid with the toner image of other colors but transferred is transferred on the transferring material by the fixing apparatus (fixing means) 354 without being mixed with the toner image of other colors, the patch P2 (single color toner image) of yellow is formed on the transferring material.

Similarly, after the cyan toner image is transferred so as to be overlaid on the yellow toner image on the transferring material 23, the cyan toner image is fixed and mixed by the fixing apparatus 354, thereby forming the patch P4.

In the color taste adjustment mode in the present embodiment also, the color taste of P1 and P2 which are the patches (single color toner images) of the single color formed on the transferring material 23 and P3 and P4 which are the patches fixed and mixed with patches (mixed toner images) of plural colors are detected by the density sensor 40. These detection procedures are the same as the detection procedures of the first embodiment (see FIGS. 7 and 8).

In the present embodiment also, similarly to the control of the first embodiment, when the difference between the magenta density of the single color patch (for example, the magenta toner patch) and the magenta density of the patch fixed and mixed with plural color patches (for example, the patch fixed and mixed with the magenta toner patch and the yellow toner patch) becomes equal to or more than a predetermined value, that is, when the re-transferring amount of the magenta toner becomes equal to or more than a predetermined amount, the control circuit CPU (control means) 100 reduces transferring target currents of yellow, cyan, and black by 5 μA. Further, when the difference between the yellow density of the yellow toner and the yellow density of the patch fixed and mixed with the yellow toner patch and the cyan toner patch becomes equal to or more than a predetermined value, that is, when the re-transferring amount of yellow becomes equal to or more than a predetermined value, the control circuit CPU 100 reduces the transferring target current of cyan and black by 5 μA. A block diagram of the color taste adjustment mode of the present embodiment is shown in FIG. 12.

In this manner, in the image forming apparatus of the present embodiment also, the problem of a color taste deviation is solved.

In the present embodiment, the re-transferring amount is calculated based on the difference between the density of the single color toner image and the single color toner image in the mixed toner images, thereby controlling the primary-transferring condition. However, the present embodiment is not limited to this method, but by measuring the density of the color of the single color toner image in the mixed toner images, and comparing this density to the value decided in advance, the primary-transferring condition can be also controlled.

In the present embodiment, though the color taste adjustment mode is executed in the preliminary rotational operating process, similarly to the first embodiment, in the rotational process after the completion of one job, and further in the case of the job of the large quantity of sheets in succession, the color taste adjustment mode is executable also once for several hundred sheets. Further, the user can execute the color taste adjustment mode at his discretion.

Fourth Embodiment

(1) Schematic Block Diagram of the Image Forming Apparatus

Figure 14:
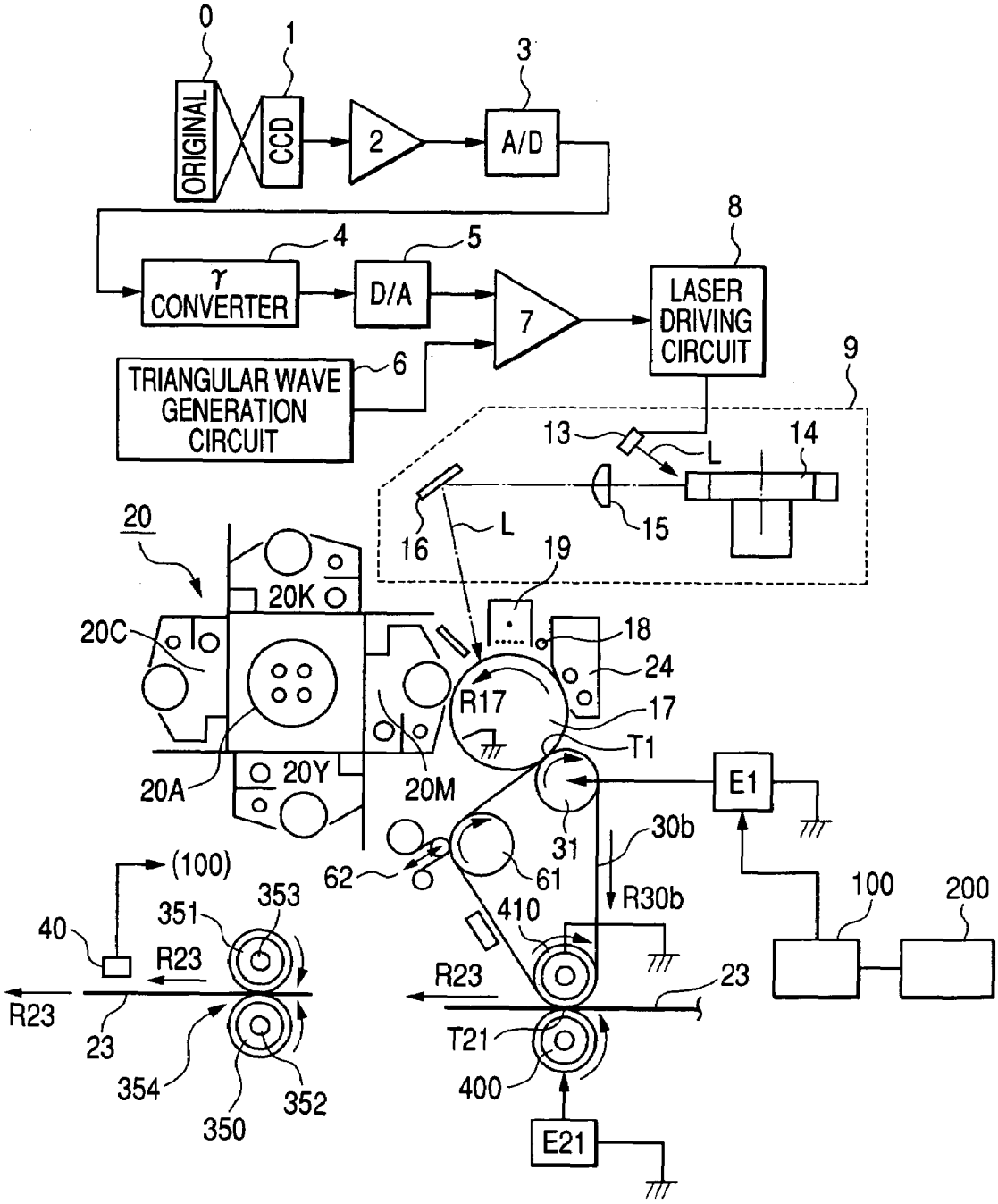
FIG. 14 is a schematic block diagram of the image forming apparatus of a fourth embodiment.

FIG. 14 is a vertical section showing a schematic block diagram of the image forming apparatus in the third embodiment. The component members and parts common to the image forming apparatus of the first embodiment will be attached with common reference numerals and a duplicative description thereof will be omitted.

The image forming apparatus of the present embodiment is the same as the image forming apparatus of the first embodiment in a process up to forming a color toner image on the surface of an intermediate transferring belt 30*b*. The surface of the photosensitive drum (image bearing member) 17 uniformly charged to predetermined polarity and potential is formed with an electrostatic image by an exposing apparatus 9 such as a scanner and the like. The electrostatic image formed on the photosensitive drum 17 is developed by a developing apparatus (toner image forming means) 20 by using a toner, and a toner image is formed. The toner image on the photosensitive drum 17 is temporarily primary-transferred on the intermediate transferring belt (intermediate transferring member) 30*b* by application of a bias, that is, a current from a high voltage output circuit (power source) E1 to a primary-transferring charging roller 31 (primary-transferring means).

As the intermediate transferring belt 30*b*, an endless tape of polyimide (PI) is used. In the present embodiment, a color toner image superposed with plural toner images on an intermediate transferring belt 30*b* is collectively transferred on the transferring material 23 by application of a bias from a high voltage output circuit (bias applied power source) E22 to a secondary transferring charging roller 400 (secondary transferring means) in the second transferring portion (nip portion) formed between the intermediate transferring member 30*b* and the secondary transferring roller 400. The secondary transferring roller 400 is a conductive elastic roller.

Subsequently, the transferring material transferred with the color toner image is conveyed to the fixing apparatus (fixing means) 354 by conveying means (not shown). The color toner image transferred to the transferring material 23 is heated and fixed (fixed and mixed) by the fixing apparatus 354, and a full color image formative matter is discharged outside of the image forming apparatus.

Here, the fixing apparatus 354 is similarly constituted as the fixing apparatus used in the third embodiment.

Reference numeral 40 denotes a density detection sensor (detecting means) for detecting a toner image fixed on the transferring material 23, and is disposed by opposing without contact to the transferring material in the downstream side of the fixing apparatus 354 in the advancing direction (arrow mark R23) of the transferring material.

(2) Full Color Image Forming Operation

The image forming apparatus of the present embodiment, similarly to the image forming apparatus of the first embodiment, forms in order four toner images of a magenta toner image, a yellow toner image, a cyan toner image, and a black toner image on the surface of the photosensitive drum 17, and these toner images are superposingly transferred on the intermediate transferring belt 30*b* in a first transferring portion T1 in a predetermined overlaid state, and the four color superposed toner images are collectively transferred on the transferring material 23 in a secondary transferring portion T21.

To describe more in detail, similarly to the first embodiment,

1) The electrostatic image formed on the surface of the photosensitive drum 17 is developed by a magenta developing device (first toner image forming means) by using a magenta toner (first toner), and a magenta toner image (first toner image) is formed. This magenta toner image is primary-transferred on the surface of the intermediate transferring belt 30*b* during its first rotation in the primary-transferring portion T1.

The magenta toner image primary-transferred on the intermediate transferring belt 30*b* passes through the secondary transferring portion T21 and the position of a cleaner 62 and reaches the primary-transferring portion T1 again by the rotation of the intermediate transferring belt 30*b*. While the primary transfer is performed, the secondary transferring roller 400 is separated from the intermediate transferring belt 30*b*. The cleaner 62 is also separated from the intermediate transferring belt 30*b*.

2) Next, an electrostatic image formed on the photosensitive drum 17 is developed by a yellow developing device (second toner image forming means) by using a yellow toner (second toner), so that a yellow toner image (second toner image) is formed. The yellow toner image is primary-transferred on the magenta toner image already primary-transferred on the surface of the intermediate transferring belt 30*b* during its second rotation in a predetermined overlaid state by application of a bias, that is, a current from a high voltage output circuit (power source) E1 to a primary-transferring charging roller (primary charging means) 31 in the primary-transferring portion T1.

3) Next, similarly to the yellow toner image, the cyan toner image formed on the photosensitive drum 17 is primary-transferred on the magenta toner image and the yellow toner image already primary-transferred on the surface of the intermediate transferring belt 30*b* during its third rotation in the primary-transferring portion T1 in a predetermined overlaid state.

4) Finally, the black toner image formed on the photosensitive drum 17 is primary-transferred on the magenta toner image, the yellow toner image, and the cyan toner image already primary-transferred on the surface of the intermediate transferring belt 30*b* during its fourth rotation in the primary-transferring portion T1 in a predetermined overlaid state.

5) Next, these toner images on the intermediate transferring belt 30*b* are collectively transferred on the transferring material 23 in the secondary transferring portion (nip portion) T21 formed between the intermediate transferring belt 30*b* and the secondary transferring roller 400 abutting against the intermediate transferring belt 30*b* by application of a bias from a high voltage output circuit (bias applied power source) E21 to the secondary transferring charging roller 400 (secondary transferring means).

The transferring material 23 transferred with the toner image is conveyed to the fixing apparatus (fixing means) 354 by conveying means (not shown), and the toner image is heated and fixed (fixed and mixed) on the transferring material 23. At this time, the toner image transferred on the transferring material overlaid with at least two toner images is mixed and fixed by the fixing apparatus 354.

In the present embodiment also, similarly to the first embodiment, a setting value of the target transferring current applied from the high voltage output circuit E1 to the primary-transferring roller 31 at the primary-transferring time of the toner image of each color from above the photosensitive drum 17 to the intermediate transferring belt 30*b* is as shown in FIG. 2. Similarly to the first embodiment, the target primary-transferring current is variably controlled by a control circuit CPU (control means) 100 based on a circumstantial moisture amount obtained from the measuring result of a environmental sensor 200 which measures temperature and humidity inside the image forming apparatus. At an actual primary-transferring time, similarly to the first embodiment, a control is made so as to let flow the target current.

After the secondary transferring, the toner remained in the intermediate transferring belt 30*b* is removed by the cleaner 62.

(3) Color Taste Adjustment Mode

In the present embodiment also, similarly to the first embodiment, based on the temperature and humidity information from the environmental sensor 200, a developing contrast potential is controlled so that the image (toner image) density on the photosensitive drum 17 becomes constant.

In the image forming apparatus of the present embodiment also, a problem sometimes arises that a balance of color of color toners superposingly transferred with plural toner images is tipped off.

Hence, in the present embodiment, in a preliminary rotational operating process, the patches (patch shaped toner images) of the single color and plural colors are overlaid on the intermediate transferring belt 30*b*, and are collectively transferred on the transferring material 23 in the secondary transferring portion T21. The transferring material 23 collectively transferred with the patches of the single color and plural colors is conveyed to the fixing apparatus 354, and the patches are fixed and mixed on the transferring material 23. The single color patch (single color toner image) and the patches of plural colors (mixed toner images) transferred on the transferring material 23 are detected in color density by the density detection sensor 40 as detecting means. Based on this detection result, the control means CPU 100 solves the above-described problem by providing the color taste adjustment mode for controlling the primary-transferring condition in the color forming process to be executed next time.

This color taste adjustment mode is not limited to be executed in the preliminary rotational operating process, but can be executed in the subsequent rotational process after the completion of one job and printing of several hundred sheets in succession, and moreover, the user can execute the color taste adjustment mode at his discretion.

A specific control method will be described below.

As shown in FIG. 14, the density detection sensor 40 is disposed by opposing without contacting the surface where the toner image of the transferring material is fixed in the downstream side of the fixing apparatus 354 in the advancing direction (arrow mark R23) of the transferring material. The density detection sensor 40*b* detects the color information of the single color patches P1 and P2 fixed and the plural color patches P3 and P4 fixed and mixed on the transferring material 23 by the fixing apparatus 354. This detected color information is inputted to the control circuit CPU 100.

FIG. 3 shows the patches P1 (magenta M single color, single color toner image), P2 (yellow Y single color), P3 (plural colors red: (M+Y), mixed toner image), and P4 (plural colors green: G(M+C)) formed on the transferring material in the present embodiment.

A forming method of the patches P1, P2, P3 and P4 will be described below in detail.

First, the electrostatic image formed on the photosensitive drum 17 (image bearing member) is developed by a magenta developing device 20M (first toner image forming means) by using a magenta toner (first toner), so that a magenta toner image (first toner image) is formed at a position where the patches P1 and P3 are formed.

The magenta toner image is primary-transferred from the photosensitive drum 17 to the intermediate transferring belt 30*b* (intermediate transferring member) by a primary charging device (primary-transferring means) 31.

Subsequently, the electrostatic image formed on the photosensitive drum 17 is developed by a yellow developing device 20Y (second toner image forming means) by using a yellow toner (second toner), so that the yellow toner image (second toner image) is formed at a position where the patches P2, P3 and P4 are formed. In other words, the yellow toner image as the second toner image is transferred on the intermediate transferring belt 30*b* by the primary-transferring charging device 31 (primary-transferring means) so as to be overlaid on the portion (here P3) of the magenta toner image as the first toner image. Further, the yellow toner image is transferred on the intermediate transferring belt 30*b* from the photosensitive drum 17 by the primary-transferring charging device 31 (primary-transferring means) so as not to be overlaid on the portion (here P1) of the magenta toner image. The magenta toner image and the yellow toner image on the intermediate transferring belt 30*b* are collectively secondary-transferred on the transferring material 23 by the secondary transferring charging roller 400. The magenta toner image and the yellow toner image secondary-transferred on the transferring material 23 are fixed and mixed on the transferring material 23 by the fixing apparatus 354, and are formed.

Similarly, the cyan toner image is primary-transferred from the photosensitive drum 17 to the intermediate transferring belt 30*b* so that the cyan toner is overlaid on the yellow toner image on the intermediate transferring belt 30*b*. The yellow toner image and the magenta toner image on the intermediate transferring belt 30*b* are secondary-transferred on the transferring material 23 by the secondary transferring roller 400, and are fixed and mixed by the fixing apparatus 354, thereby obtaining the patch P4.

The formation of these patches P1, P2, P3, and P4 is performed in the preliminary rotational process. This formation is executable in the subsequent rotational process and for every predetermined number of sheets at the time of continuous printing in a large quantity. Further, the user can also execute the color taste adjustment mode at his discretion.

The formation of such patches is made in such a manner that a process of primary-transferring on the intermediate transferring belt 30*b* is repeated at least for two color toners, and a toner image overlaid with a single color toner image and at least two color toner images is formed on the intermediate transferring belt 30*b*, and is collectively transferred on the transferring member 23 by the secondary transferring charging roller 400 (secondary transferring means), and is fixed on the transferring material 23 by the fixing apparatus 354.

That is, the magenta toner image and the yellow toner image primary-transferred on the intermediate transferring belt 30 are collectively transferred on the transferring material 23 by the secondary transferring roller 400. Subsequently, in the portion overlaid with the magenta toner image and the yellow toner image, the magenta toner image and the yellow toner image are fixed and mixed by the fixing apparatus 354, and the patch P3 (mixed toner image) of red is formed on the transferring material 23. Further, in the magenta toner image, the portion transferred without the toner images of other colors overlaid is fixed on the transferring material without being mixed with the toner images of other colors, and the patch P1 (single color toner image) of magenta is formed on the transferring material.

In the yellow toner image, the portion not primary-transferred with other toner images overlaid is secondary-transferred on the transferring material 23, and is fixed on the transferring material without being mixed with the toner images of other colors, and the patch P2 of a yellow single color is formed on the transferring material 23.

In FIGS. 4A and 4B is shown a constitution of the density sensor 40 as detecting means used in the present embodiment. Since the constitution is the same as the density detection sensor 40*a* of the first embodiment, the description thereof will be omitted.

A color separation filter used in the present embodiment uses the same filter used in the first embodiment. The spectral characteristic thereof is shown in FIG. 5. The toner used in the present embodiment also uses the same toner used in the first embodiment. In FIG. 6 is shown a spectral reflection characteristic of each color toner.

The light irradiated from a light source 41 is reflected by the patches P (1 to 4) which are fixed and mixed on the intermediate transferring belt 30*b*, and enters a light receiving element 42 through color separation filters 43R, 43G, and 43B of each color.

In the color taste adjustment mode in the present embodiment, the color taste of P1 and P2 which are the patches (single color toner images) of the single color and P3 and P4 which are the patches fixed and mixed with the patches (mixed toner images) of plural colors formed on the transferring material is detected by the density sensor 40*b*. These detection procedures are the same as the detection procedures of the first embodiment (see FIGS. 7 and 8).

In the present embodiment also, similarly to the control of the first embodiment, when the difference between the magenta density of the single color patch (for example, the magenta toner patch) and the magenta density of the patch fixed and mixed with the patches (for example, the patch fixed and mixed with the magenta toner patch and the yellow toner patch) of plural colors becomes equal to or more than a predetermined value, that is, when the re-transferring amount of the magenta toner becomes equal to or more than a predetermined amount, a control circuit CPU100 reduces a primary-transferring target currents of yellow, cyan and black by 5 μA. Further, when the difference between the yellow density of the patch of the yellow toner and the yellow density of the patch fixed and mixed with the yellow toner patch and the cyan toner patch becomes equal to or more than a predetermined value, that is, when the re-transferring amount of yellow becomes equal to or more than a predetermined amount, the control circuit CPU 100 reduces the primary-transferring target currents of cyan and black by 5 μA.

As described above, the toner patches P1, P2, P3, and P4 of the single color and plural colors are fixed on the transferring material 23, and every color information on each toner patch is detected, and a primary-transferring condition is corrected, so that a problem of a color taste deviation can be solved even in the image forming apparatus which fixes the toner image transferred on the transferring material 23 from the intermediate transferring belt 30*b* by the fixing apparatus 354.

In the present embodiment, though the color taste adjustment mode is executed in the preliminary rotational operating process, similarly to the first embodiment, in the rotational process after the completion of one job, and further, in the case of the job in a large quantity in succession, the color taste adjustment mode is executable also once for several hundred sheets. Further, the user can execute the color taste adjustment mode at his discretion.

In the present embodiment, though the re-transferring amount is calculated and the primary-transferring condition is controlled based on the difference between the density of the single color toner image and the density of the color of the single color toner image in the mixed toner images, by measuring the density of the color of the single color toner image in the mixed toner images, and comparing this to the predetermined value, the primary-transferring condition can be also controlled.

The transferring material 23 after the detection by the density detection sensor 40*b* is discharged outside of the image forming apparatus by a conveying apparatus (not shown). Further, the correction of the primary-transferring condition can also directly control the primary-transferring bias in addition to the primary-transferring target current.

Fifth Embodiment

Figure 15:
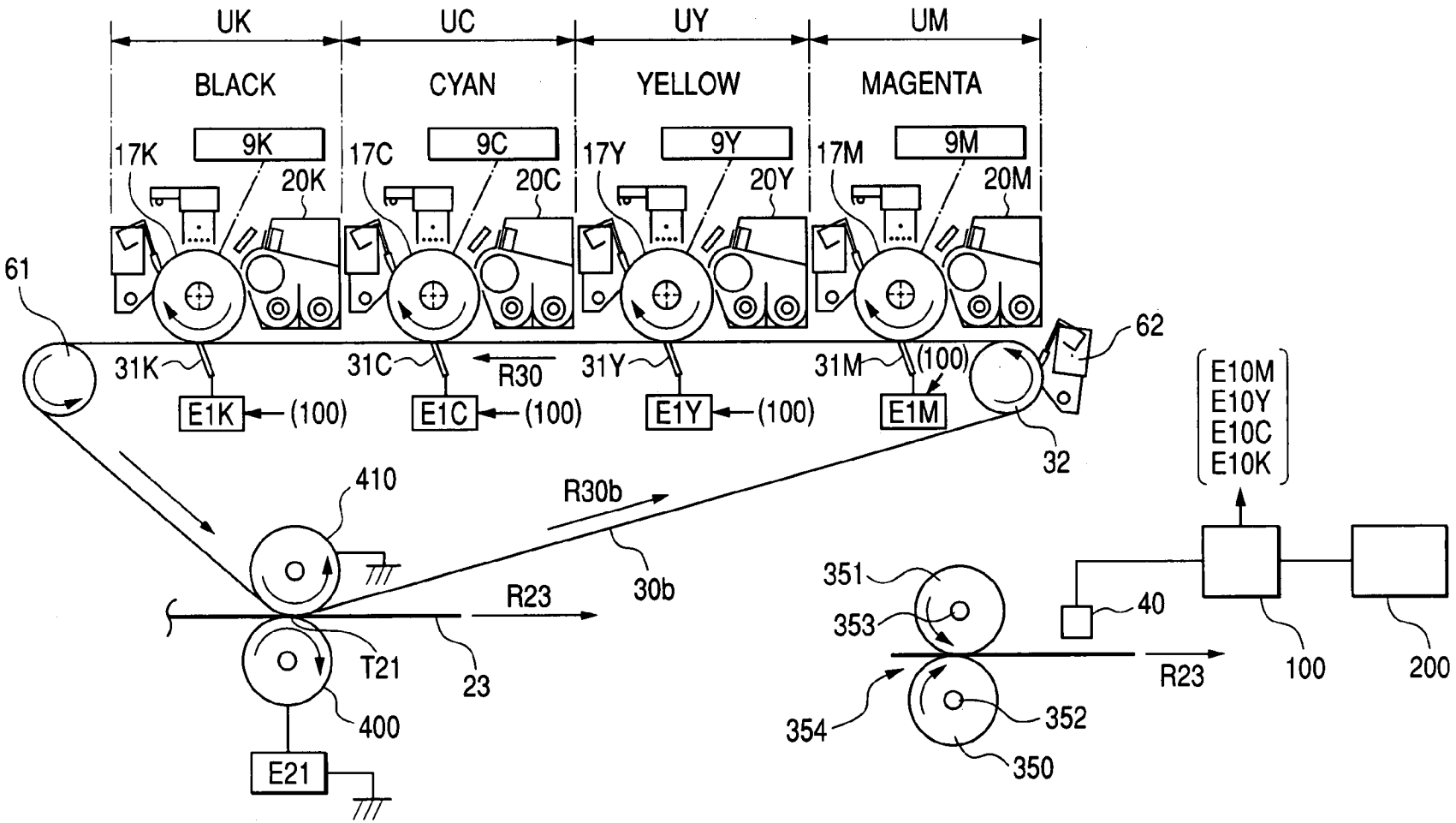
FIG. 15 is a schematic block diagram of the image forming apparatus of a fifth embodiment.
Figure 16:
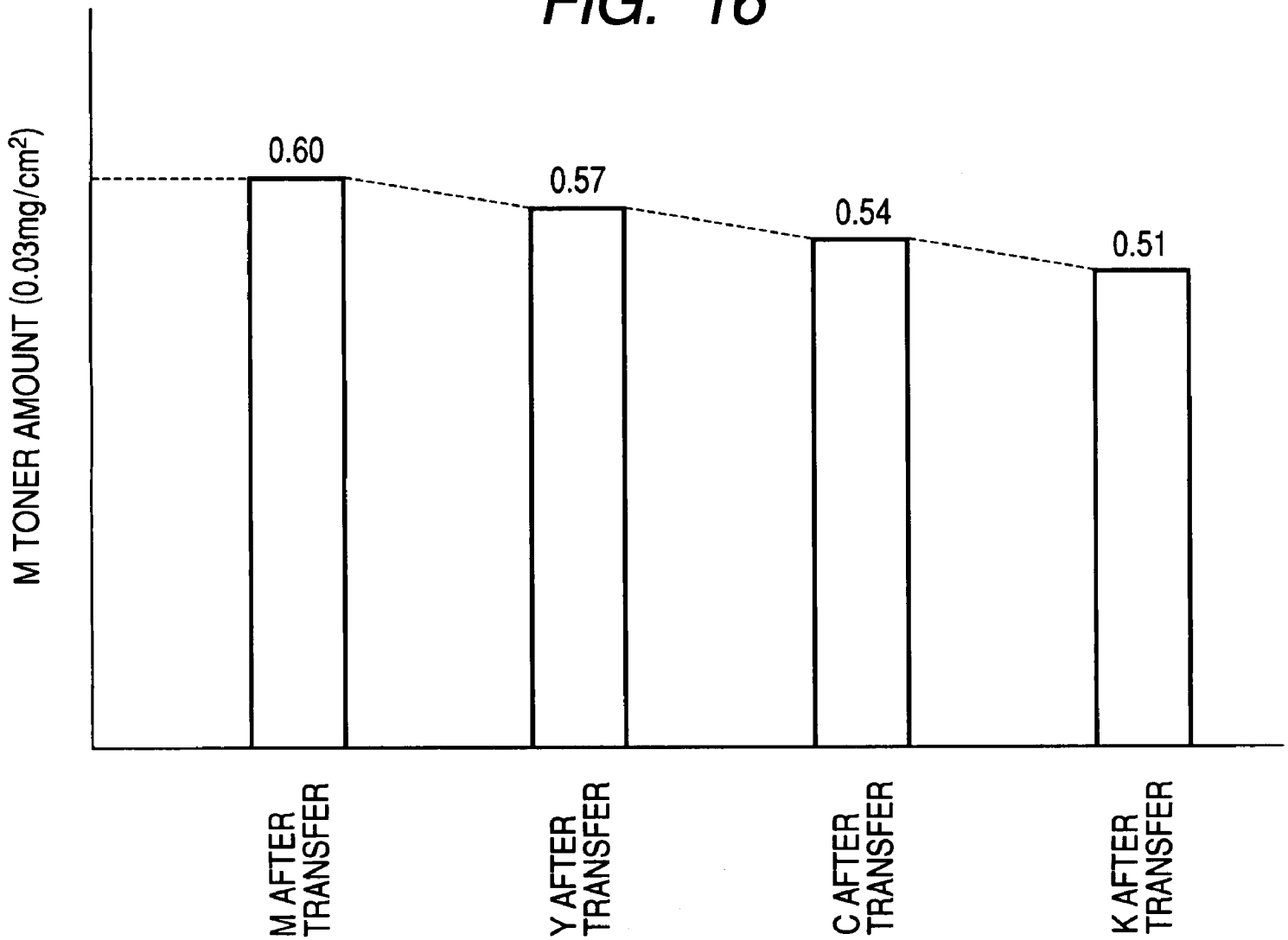
FIG. 16 is a view explaining a conventional example.

FIG. 15 is a vertical section showing a schematic block diagram of an image forming apparatus in a fifth embodiment. The component elements and parts common to the above described embodiments are attached with common reference numerals, and a duplicative description thereof will be omitted.

The image forming apparatus of the present embodiment is such that electrophotographic photosensitive members as image bearing members of the same number of colors required for an image, charging means, image exposing means, developing means are provided in the vicinity of each electrophotographic photosensitive member, and the toner images of a single color formed on each electrophotographic photosensitive member are superposed in order on an intermediate transferring member (transferring medium) and are primary-transferred, so that color toner images composed by overlaying each color toner image on the intermediate transferring member are synthetically formed, and these color toner images synthetically formed are collectively secondary-transferred on a transferring material. The transferring material transferred with the color toner images is conveyed to the fixing apparatus, and by the fixing apparatus, the color toner images are fixed and mixed on the transferring material, thereby obtaining a full color image formative matter.

This image forming apparatus, similarly to the second embodiment, comprises four sets of the first to fourth image forming units UM, UY, UC, and UK. The detailed constitution of each unit is the same as the image forming unit of the second embodiment, and is as shown in FIG. 11.

Each image forming unit comprises a photosensitive drum (image bearing member) 17 rotationally driven clockwise in the direction of an arrow mark R17 at a predetermined peripheral velocity, a primary charging device 19 for uniformly charging the surface of the photosensitive drum 17 to predetermined polarity and potential, an exposing apparatus 9 for forming an electrostatic image as a light figure exposure L on the uniformly charged surface of the photosensitive drum 17, a developing apparatus (toner image forming means) 20 for developing the electrostatic latent image as a toner image by the toner, primary-transferring charging devices (transferring means) 31M, 31Y, 31C, and 31K for transferring the toner image on the intermediate transferring belt (intermediate transferring member) 30 in a primary-transferring portion T1, a secondary transferring charging device (secondary transferring means) 450 for secondary-transferring the toner image on the intermediate transferring belt 30 to the transferring material 23 in the secondary transferring portion T2, a fixing apparatus 354 for fixing and mixing the toner image on the transferring material, and the like.

The first image forming unit UM develops an electrostatic image formed on a photosensitive drum 17M (first image bearing member) by a magenta developing device 20M (first toner image forming means) by using a magenta toner (first toner), and a magenta toner image (first toner image) is formed on the photosensitive drum 17M.

The second image forming unit UY develops the electrostatic image formed on a photosensitive drum 17Y (second image bearing member) by a yellow developing device 20Y (second toner image forming means) by using a yellow toner (second toner), and a yellow toner image (second toner image) is formed on the photosensitive drum 17Y.

Similarly, the third image forming unit UC forms a cyan toner image on a photosensitive drum 17C. The fourth image forming unit UK forms a black toner image on a photosensitive drum 17K.

The transferring material conveying belt 30 has a belt portion of the ascending side run across the underside of the photosensitive drum 17 of each image forming unit located at the bottom of the first to fourth image forming units UM, UY, UC, and UK so as to allow the belt portion to span and stretch among three spanning rollers of a driving roller 32, a tension roller 61, and a secondary transferring transferring opposed roller 410. The intermediate transferring belt 30*b* is rotationally driven counter-clockwise in the direction of an arrow mark R30*b* approximately at the same peripheral velocity as the rotational peripheral velocity of the photosensitive drum 17 by the rotational driving of the driving roller 32.

The primary-transferring charging devices 31M, 31Y, 31C, and 31K in each of the first to fourth image forming units UM, UY, UC, and UK are disposed at the rear side (internal side) of the intermediate transferring belt 30, respectively, and are compressed to the undersurface of the corresponding photosensitive drums 17M, 17Y, 17C, and 17K through the ascending side belt portion (belt portion between the driving roller 32 and the tension roller 61) of the intermediate transferring belt 30, and form a primary-transferring portion (nip portion) T1 between the photosensitive drum 17 and the surface (outer surface side) of the intermediate transferring belt 30. Each of an E1M, an E1Y, an E1C, and an E1K is a high voltage output circuit (bias applied power source, power source) for the primary-transferring charging devices 31M, 31Y, 31C and 31K.

When the current is applied to the transferring charging device 31M (first transferring means) which is opposed to the photosensitive drum 17M through the intermediate transferring belt 30*b* from a high voltage output circuit (power source) E1M, the magenta toner image formed on the photosensitive drum 17M of the first image forming unit UM is primarily-transferred on the intermediate transferring belt 30*b*.

When the current is applied to the transferring charging device 31Y (second transferring means) which is opposed to the photosensitive drum 17Y through the intermediate e transferring belt 30*b* from a high voltage output circuit (power source) E1Y, the yellow toner image formed on the photosensitive drum 17Y of the second image forming unit UY is primarily-transferred on the intermediate transferring belt 30*b*.

Similarly, the cyan and block toner images are transferred on the intermediate transferring belt 30*b* from the third and fourth image forming units UC and UK.

Reference numeral 400 denotes a secondary transferring charging device (secondary transferring means) which secondary-transferrers the toner image on the intermediate transferring belt 30*b*. Reference numeral E21 denotes a high voltage output circuit for the secondary transferring charging unit 450.

Reference numeral 354 denotes a fixing apparatus (fixing means), which fixes and mixes the toner image on the transferring material 23. The fixing apparatus is constituted similarly as the fixing apparatus of the third and fourth embodiments, and comprises a fixing roller 351 provided at an unfixed toner side of the transferring material and a pressure roller 350 provided at the opposite side through the transferring material 23.

Reference numeral 62 is a cleaner, which recovers a toner remained on the intermediate transferring belt 30*b* after the secondary transfer.

Reference numeral 40 denotes a density detection sensor (detecting means) for detecting a toner image fixed on the transferring material, and is disposed by opposing without contacting the transferring material 23 in the downstream side of the fixing apparatus 354 in the advancing direction (arrow mark R23) of the transferring material.

A full color image forming operation is as follows.

The first to fourth image forming units UM, UY, UC, and UK are driven in order in the exact timing with the image formation. Further, the intermediate transferring belt 30*b* is also rotationally driven. The surface of the photosensitive drum 17 of the first image forming unit UM is formed with a toner image of a magenta component of the full color image, the surface of the photosensitive drum 17 of the second image forming unit UY is formed with a toner image of a yellow component of the full color image, the surface of a photosensitive member 11 of the third image forming unit C is formed with a toner image of a cyan component of the full color image, and the surface of the photosensitive member 11 of the fourth image forming unit K is formed with a toner image of a black component of the full color image at a predetermined timing, respectively.

The yellow toner image, the magenta toner image, the cyan toner image, and the black toner image formed on the photosensitive drum 17 of each image forming unit UM, UY, UC, and UK are superposedly transferred in order in a positioning state on the surface of the intermediate transferring belt 30 in the primary-transferring unit T1 of the image forming unit, thereby synthetically forming an unfixed full color toner image on the surface of the intermediate transferring belt 30*b*.

In each of the first to fourth image forming units UM, UY, UC, and UK, a bias apply from the high voltage output circuits E1M, E1Y, E1C, and E1K to the transferring charging devices 31M, 31Y, 31C, and 31K at the transferring time from the surface of the photosensitive drum 17 to the surface of the transferring material conveying belt 30, similarly to the first embodiment, is subjected to a constant voltage control, and is controlled so that a primary-transferring current is let flow along a target current. The primary current which is allowed to flow along the target current is variably controller by a control circuit CPU (control means) 100 based on a circumstantial moisture amount obtained from the measuring result of a environmental sensor 200 which measures temperature and humidity inside the image forming apparatus.

In a predetermined timing with conveyance of the four color superposed toner images to the secondary transferring portion T21 by the continuous rotation of the intermediate transferring belt 30*b* and arrival of the top end portions of those toner images at the secondary transferring portion T21, the transferring material 23 is similarly fed from a sheet feeding apparatus (not shown) so that the top end portions reach the secondary transferring portion T21. Further, a bias of reverse polarity to the charging polarity of the toner is applied to the secondary transferring transferring roller 400 from the high voltage output circuit E21. In this manner, the four color superposed toner images on the intermediate transferring belt 30*b* are collectively secondary-transferred on the transferring material 23 in the secondary transferring portion T2.

Subsequently, the transferring material 23 transferred with the toner image is conveyed to the fixing apparatus (fixing means) 354 by conveying means (not shown). The toner image is heated and fixed (fixed and mixed) on the transferring material 23, and a full color image formative matter is discharged outside of the image forming apparatus main body.

The toner not transferred on the transferring material 23 in the secondary transferring portion T21 but remaining on the surface of the intermediate transferring belt 30*b* is removed by the cleaner 62, and the intermediate transferring belt 30 is repeatedly provided for image formation.

The image forming apparatus of the present embodiment also, similarly to the fourth embodiment, comprises a color taste adjustment mode, which detects the patches of the single color and plural colors formed on the transferring material 23 and controls a primary-transferring condition.

In the image forming apparatus of the present embodiment also, similarly to the image forming apparatus of the fourth embodiment, in the preliminary rotational operating process of the image forming apparatus, the patches P1, P2, P3, and P4 shown in FIG. 3 are formed on the transferring material 23.

The forming method of these patches is as follows.

The electrostatic image formed on the photosensitive drum 17M (first image bearing member) is developed by the magenta developing device 20M (first toner image forming means) by using the magenta toner (first toner), so that the magenta toner image (first toner image) is formed at the position where the patches P1 and P2 are formed. This magenta toner image is primary-transferred on the intermediate transferring belt (intermediate transferring member) 30 from the photosensitive drum 17M by the primary-transferring charging device 31M (first primary-transferring means). Subsequently, the electrostatic image formed on the photosensitive drum 17Y (second imager bearing member) is developed by the yellow developing device 20Y (second toner image forming means) by using the yellow toner (second toner), so that the yellow toner image (second toner image) is formed at the position where the patches P2, P3 and P4 are formed. The yellow toner image as the second toner image is transferred on the intermediate transferring belt 30*b* from the photosensitive drum 17Y by the primary-transferring charging device 31Y (second primary-transferring means) so as to be overlaid on a portion (here P3) of the magenta toner image as the first toner image. Further, the magenta toner image is transferred on the intermediate transferring belt 30*b* from the photosensitive drum 17Y by the primary-transferring charging device 31Y (second transferring means) so as not to be overlaid on a portion (here P1) of the yellow toner image.

The magenta toner image and the yellow toner image primary-transferred on the intermediate transferring belt 30*b* are collectively secondary-transferred on the transferring material 23 by the secondary transferring roller 400. Subsequently, in the portion overlaid with the magenta toner image and the yellow toner image, the magenta toner image and the yellow toner image are fixed and mixed by the fixing apparatus 354, and the patch P3 (mixed toner image) of red is formed on the transferring material 23. Further, in the magenta toner image, the portion primary-transferred on the intermediate transferring belt 30*b* without the toner images of other colors overlaid is secondary-transferred on the transferring material 23, and after that, is fixed on the transferring material 23 by the fixing apparatus 354 without being mixed with the toner images of other colors, and the patch P1 (single color toner image) of magenta is formed on the transferring material. In the yellow toner image, the portion primary-transferred on the intermediate transferring belt 30*b* without the toners of other colors overlaid is secondary-transferred on the transferring material 23, and after that, is fixed on the transferring material 23 by the fixing apparatus 354 without being mixed with the toners of other colors, and the patch P1 (single toner image) of yellow is formed on the transferring material.

Similarly, the cyan toner image primary-transferred on the intermediate transferring belt 30*b* so as to be overlaid on the yellow toner image on the intermediate transferring belt 30*b* is secondary-transferred on the transferring material 23, and after that, is fixed and mixed by the fixing apparatus 354, and the patch P4 is formed on the transferring material 23.

In the color taste adjustment mode in the present embodiment also, the color taste of P1 and P2 which are the patches (single color toner images) of the single color and P3 and P4 which are the patches fixed and mixed with the patches (mixed toner images) of plural colors formed on the transferring material 23 is detected by the density sensor 40. These detection procedures are the same as the detection procedures of the first embodiment (see FIGS. 7 and 8).

In the present embodiment also, similarly to the control of the fourth embodiment, when the difference between the magenta density of the single color patch (for example, the magenta toner patch) and the magenta density of the patch fixed and mixed with the patches (for example, the patch fixed and mixed with the magenta toner patch and the yellow toner patch) of plural colors becomes equal to or more than a predetermined value, that is, when the re-transferring amount of the magenta toner becomes equal to or more than a predetermined amount, a control circuit CPU100 (control means) reduces primary-transferring target currents of yellow, cyan and black by 5 μA. Further, when the difference between the yellow density of the patch of the yellow toner and the yellow density of the patch fixed and mixed with the yellow toner patch and the cyan toner patch becomes equal to or more than a predetermined value, that is, when the re-transferring amount of yellow becomes equal to or more than a predetermined amount, the control circuit CPU 100 reduces the primary-transferring target currents of cyan and black by 5 μA. The block diagram of the color taste adjustment mode of the present embodiment is shown in FIG. 12.

In this manner, in the image forming apparatus of the present embodiment also, the problem of a color taste deviation can be solved.

In the present embodiment, though the color taste adjustment mode is executed in the preliminary rotational operating process, similarly to the first embodiment, in the rotational process after the completion of one job, and further, in the case of the job in a large quantity in succession, the color taste adjustment mode is executable also once for several hundred sheets. Further, the user can execute the color taste adjustment mode at his discretion.

In the present embodiment, the re-transferring amount is calculated based on the difference between the density of the single color toner image and the single color toner image in the mixed toner images, thereby controlling the primary-transferring condition. However, the present embodiment is not limited to this method, but by measuring the density of the color of the single color toner image in the mixed toner images, and comparing this density to the value decided in advance, the primary-transferring condition can also be controlled.

This application claims priority from Japanese Patent Application No. 2004-060449 filed on Mar. 4, 2004, which is hereby incorporated by reference herein.

What is claimed is:

1. An image forming apparatus comprising:

an image bearing member, which bears a first color toner image of a first color;

an intermediate transferring member, which bears a second color toner image of a second color;

transfer means, which electrostatically transfers the first color toner image from said image bearing member to superpose the first color toner image onto the second color toner image on said intermediate transferring member;

a transferring fixing member, which contacts said intermediate transferring member to form a transfer nip portion, transfers and heats a superposed image on said intermediate transferring member to a recording material nipped by the transfer nip portion, and heats the superposed image on said intermediate transferring member while a recording material is not nipped by the nip portion;

detection means which detects an area where a heated second color toner image heated by said transferring fixing member laps over a heated first color toner image heated by said transferring fixing member on said intermediate transferring member; and control means, which controls a current value applied to the transfer nip portion when an image is transferred, based on a detection result of said detection means, wherein said detection means detects an area where a heated second color toner image heated by said transferring fixing member does not lap over a heated first color toner image heated by said transferring fixing member, wherein said control means controls the current value based on detection results for areas where a heated second color toner image heated by said transferring fixing member laps over a heated first color toner image heated by said transferring fixing member on said intermediate transferring member, and where a heated second color toner image heated by said transferring fixing member does not lap over a heated first color toner image heated by said transferring fixing member, and wherein in a case where a difference between a density in the area where a heated second color toner image heated by said transferring fixing member laps over a heated first color toner image heated by said transferring fixing member on said intermediate transferring member and a density in the area where a heated second color toner image heated by said transferring fixing member does not lap over a heated first color toner image heated by said transferring fixing member on said intermediate transferring member is equal to or more than a predetermined value, said control means controls the current value to be less than a current value in a case where the difference is less than the predetermined value.

* * * * *

UNITED STATES PATENT AND TRADEMARK OFFICE

CERTIFICATE OF CORRECTION

PATENT NO. : 7,340,191 B2
APPLICATION NO. : 11/068931
DATED : March 4, 2008
INVENTOR(S) : Toshiyuki Yamada It is certified that error appears in the above-identified patent and that said Letters Patent is hereby corrected as shown below:

ON THE TITLE PAGE:

At Item (56), References Cited, FOREIGN PATENT DOCUMENTS, Line 1, "10010883 A" should read --10-10883--.

COLUMN 1:

Line 20, "occurred" should read --occurring--.

COLUMN 2:

Line 1, "an" should read --a--.
Line 4, "an" (both occurrences) should read --a--.

COLUMN 3:

Line 45, "an" should read --a--.

COLUMN 6:

Line 44, "For the" should read --The--; and "example, a" should read --example, may be a--.
Line 54, "degree" should read --degress--.

COLUMN 13:

Line 17, "above described" should read --above-described--.

COLUMN 15:

Line 53, "imager" should read --image--.
Line 54, "each" should read --each of the--.
Line 61, "apply" should read --applied--.

COLUMN 18:

Line 20, "sheets." should read --of sheets.--.
Line 33, "drum-shape" should read --drum-shaped--.

COLUMN 21:

Line 11, "apply" should read --applied--.

COLUMN 24:

Line 8, "contact to" should read --contacting--.

UNITED STATES PATENT AND TRADEMARK OFFICE

CERTIFICATE OF CORRECTION

PATENT NO. : 7,340,191 B2
APPLICATION NO. : 11/068931
DATED : March 4, 2008
INVENTOR(S) : Toshiyuki Yamada It is certified that error appears in the above-identified patent and that said Letters Patent is hereby corrected as shown below:

COLUMN 28:

Line 5, "a" should be deleted.

Line 53, "above described" should read --above-described--.

COLUMN 30:

Line 32, "ondary-transferrers" should read --ondary-transfers--.

COLUMN 31:

Line 22, "controller" should read --controlled--.

Signed and Sealed this

Sixteenth Day of September, 2008

JON W. DUDAS
*Director of the United States Patent and Trademark Office*